US007794278B2

(12) United States Patent
Cohen et al.

(10) Patent No.: US 7,794,278 B2
(45) Date of Patent: Sep. 14, 2010

(54) ELECTRICAL CONNECTOR LEAD FRAME

(75) Inventors: Thomas S. Cohen, New Boston, NH (US); Brian Kirk, Amherst, NH (US); Jason E. Chan, Nashua, NH (US); Andreas C. Pfahnl, Goffstown, NH (US); Marc B. Cartier, Jr., Dover, NH (US); David Manter, Windham, NH (US)

(73) Assignee: Amphenol Corporation, Wallingford, CT (US)

( * ) Notice: Subject to any disclaimer, the term of this patent is extended or adjusted under 35 U.S.C. 154(b) by 167 days.

(21) Appl. No.: 12/062,581

(22) Filed: Apr. 4, 2008

(65) Prior Publication Data

US 2008/0248658 A1 Oct. 9, 2008

Related U.S. Application Data

(60) Provisional application No. 60/921,741, filed on Apr. 4, 2007.

(51) Int. Cl.
*H01R 13/648* (2006.01)

(52) U.S. Cl. ..... 439/607.09; 439/108

(58) Field of Classification Search ..... 439/108, 439/941, 607.09

See application file for complete search history.

(56) References Cited

U.S. PATENT DOCUMENTS

| | | | |
|---|---|---|---|
| 4,175,821 | A | 11/1979 | Hunter |
| 4,519,665 | A | 5/1985 | Althouse et al. |
| 4,607,907 | A | 8/1986 | Bogursky |
| 4,871,316 | A | 10/1989 | Herrell et al. |
| 5,346,410 | A | 9/1994 | Moore, Jr. |
| 5,993,259 | A | 11/1999 | Stokoe et al. |
| 6,174,944 | B1 | 1/2001 | Chiba et al. |
| 6,350,134 | B1 | 2/2002 | Fogg et al. |
| 6,379,188 | B1 | 4/2002 | Cohen et al. |
| 6,409,543 | B1 | 6/2002 | Astbury et al. |
| 6,506,076 | B2 | 1/2003 | Cohen et al. |

(Continued)

FOREIGN PATENT DOCUMENTS

| | | |
|---|---|---|
| WO | WO 2007/005597 A2 | 1/2007 |

(Continued)

OTHER PUBLICATIONS

Tyco Electronics, "High Speed Backplane Connectors," Product Catalog No. 1773095, Revised Dec. 2008, pp. 1-40.

*Primary Examiner*—Tho D Ta
(74) *Attorney, Agent, or Firm*—Wolf, Greenfield & Sacks, P.C.

(57) ABSTRACT

An electrical interconnection system with high speed, differential electrical connectors. The connector is assembled from wafers containing columns of conductive elements, some of which form differential pairs. Each column may include ground conductors adjacent pairs of signal conductors. The ground conductors may be wider than the signal conductors, with ground conductors between adjacent pairs of signal conductors being wider than ground conductors positioned at an end of at least some of the columns. Each of the conductive elements may end in a mating contact portion positioned to engage a complementary contact element in a mating connector. The mating contact portions of the signal conductors in some of the pairs may be rotated relative to the columns. The printed circuit board to which the differential signal connector is mounted may be constructed with elongated antipads around pairs of signal conductors.

15 Claims, 16 Drawing Sheets

U.S. PATENT DOCUMENTS

| | | | | |
|---|---|---|---|---|
| 6,540,559 | B1 | 4/2003 | Kemmick et al. | |
| 6,554,647 | B1 | 4/2003 | Cohen et al. | |
| 6,565,387 | B2 | 5/2003 | Cohen | |
| 6,592,381 | B2 | 7/2003 | Cohen et al. | |
| 6,602,095 | B2 | 8/2003 | Astbury, Jr. et al. | |
| 6,607,402 | B2 | 8/2003 | Cohen et al. | |
| 6,652,319 | B1 | 11/2003 | Billman | |
| 6,709,294 | B1 | 3/2004 | Cohen et al. | |
| 6,786,771 | B2 | 9/2004 | Gailus | |
| 6,808,420 | B2 | 10/2004 | Whiteman et al. | |
| 6,875,031 | B1 | 4/2005 | Korsunsky et al. | |
| 6,932,649 | B1 | 8/2005 | Rothermel et al. | |
| 6,979,202 | B2 | 12/2005 | Benham | |
| 7,044,794 | B2 | 5/2006 | Consoli et al. | |
| 7,094,102 | B2 | 8/2006 | Cohen et al. | |
| 7,108,556 | B2 | 9/2006 | Cohen et al. | |
| 7,163,421 | B1 | 1/2007 | Cohen et al. | |
| 7,316,585 | B2 | 1/2008 | Smith et al. | |
| 7,335,063 | B2 | 2/2008 | Cohen et al. | |
| 7,371,117 | B2 | 5/2008 | Gailus | |
| 7,473,138 | B2 * | 1/2009 | Tuin et al. | 439/607.05 |
| 7,494,383 | B2 | 2/2009 | Cohen et al. | |
| 7,581,990 | B2 | 9/2009 | Kirk et al. | |
| 2001/0012730 | A1 | 8/2001 | Ramey et al. | |
| 2001/0046810 | A1 | 11/2001 | Cohen et al. | |
| 2002/0098738 | A1 | 7/2002 | Astbury, Jr. et al. | |
| 2002/0111069 | A1 | 8/2002 | Astbury, Jr. et al. | |
| 2002/0123266 | A1 | 9/2002 | Ramey et al. | |
| 2003/0220018 | A1 | 11/2003 | Winings et al. | |
| 2004/0171305 | A1 | 9/2004 | McGowan et al. | |
| 2004/0235352 | A1 | 11/2004 | Takemasa | |
| 2005/0048838 | A1 | 3/2005 | Korsunsky et al. | |
| 2005/0048842 | A1 | 3/2005 | Benham et al. | |
| 2005/0176835 | A1 | 8/2005 | Kobayashi et al. | |
| 2006/0068640 | A1 | 3/2006 | Gailus | |
| 2006/0073709 | A1 | 4/2006 | Reid | |
| 2006/0292932 | A1 | 12/2006 | Benham et al. | |
| 2007/0004282 | A1 | 1/2007 | Cohen et al. | |
| 2007/0021000 | A1 | 1/2007 | Laurx | |
| 2007/0021001 | A1 | 1/2007 | Laurx et al. | |
| 2007/0021002 | A1 | 1/2007 | Laurx et al. | |
| 2007/0021003 | A1 | 1/2007 | Laurx et al. | |
| 2007/0021004 | A1 | 1/2007 | Laurx et al. | |
| 2007/0042639 | A1 | 2/2007 | Manter et al. | |
| 2007/0059961 | A1 | 3/2007 | Cartier et al. | |
| 2008/0194146 | A1 | 8/2008 | Gailus | |
| 2008/0246555 | A1 | 10/2008 | Kirk et al. | |
| 2008/0248658 | A1 | 10/2008 | Cohen et al. | |
| 2008/0248659 | A1 | 10/2008 | Cohen et al. | |
| 2009/0011641 | A1 | 1/2009 | Cohen et al. | |
| 2009/0239395 | A1 | 9/2009 | Cohen et al. | |
| 2009/0291593 | A1 | 11/2009 | Atkinson et al. | |

FOREIGN PATENT DOCUMENTS

| | | | |
|---|---|---|---|
| WO | WO 2007/005598 | A2 | 1/2007 |
| WO | WO 2008/124052 | A1 | 10/2008 |
| WO | WO 2008/124054 | A1 | 10/2008 |
| WO | WO 2008/124057 | A1 | 10/2008 |
| WO | WO 2008/124101 | A1 | 10/2008 |

* cited by examiner

ELECTRICAL CONNECTOR LEAD FRAME

CROSS-REFERENCE TO RELATED APPLICATIONS

This application claims priority to U.S. Provisional Application 60/921,741, filed Apr. 4, 2007 and incorporated herein by reference.

BACKGROUND OF INVENTION

1. Field of Invention

This invention relates generally to electrical interconnection systems and more specifically to improved signal integrity in interconnection systems, particularly in high speed electrical connectors.

2. Discussion of Related Art

Electrical connectors are used in many electronic systems. It is generally easier and more cost effective to manufacture a system on several printed circuit boards ("PCBs") that are connected to one another by electrical connectors than to manufacture a system as a single assembly. A traditional arrangement for interconnecting several PCBs is to have one PCB serve as a backplane. Other PCBs, which are called daughter boards or daughter cards, are then connected through the backplane by electrical connectors.

Electronic systems have generally become smaller, faster and functionally more complex. These changes mean that the number of circuits in a given area of an electronic system, along with the frequencies at which the circuits operate, have increased significantly in recent years. Current systems pass more data between printed circuit boards and require electrical connectors that are electrically capable of handling more data at higher speeds than connectors of even a few years ago.

One of the difficulties in making a high density, high speed connector is that electrical conductors in the connector can be so close that there can be electrical interference between adjacent signal conductors. To reduce interference, and to otherwise provide desirable electrical properties, shield members are often placed between or around adjacent signal conductors. The shields prevent signals carried on one conductor from creating "crosstalk" on another conductor. The shield also impacts the impedance of each conductor, which can further contribute to desirable electrical properties.

Other techniques may be used to control the performance of a connector. Transmitting signals differentially can also reduce crosstalk. Differential signals are carried on a pair of conducting paths, called a "differential pair." The voltage difference between the conductive paths represents the signal. In general, a differential pair is designed with preferential coupling between the conducting paths of the pair. For example, the two conducting paths of a differential pair may be arranged to run closer to each other than to adjacent signal paths in the connector. No shielding is desired between the conducting paths of the pair, but shielding may be used between differential pairs. Electrical connectors can be designed for differential signals as well as for single-ended signals.

Examples of differential electrical connectors are shown in U.S. Pat. No. 6,293,827, U.S. Pat. No. 6,503,103, U.S. Pat. No. 6,776,659, and U.S. Pat. No. 7,163,421, all of which are assigned to the assignee of the present application and are hereby incorporated by reference in their entireties.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
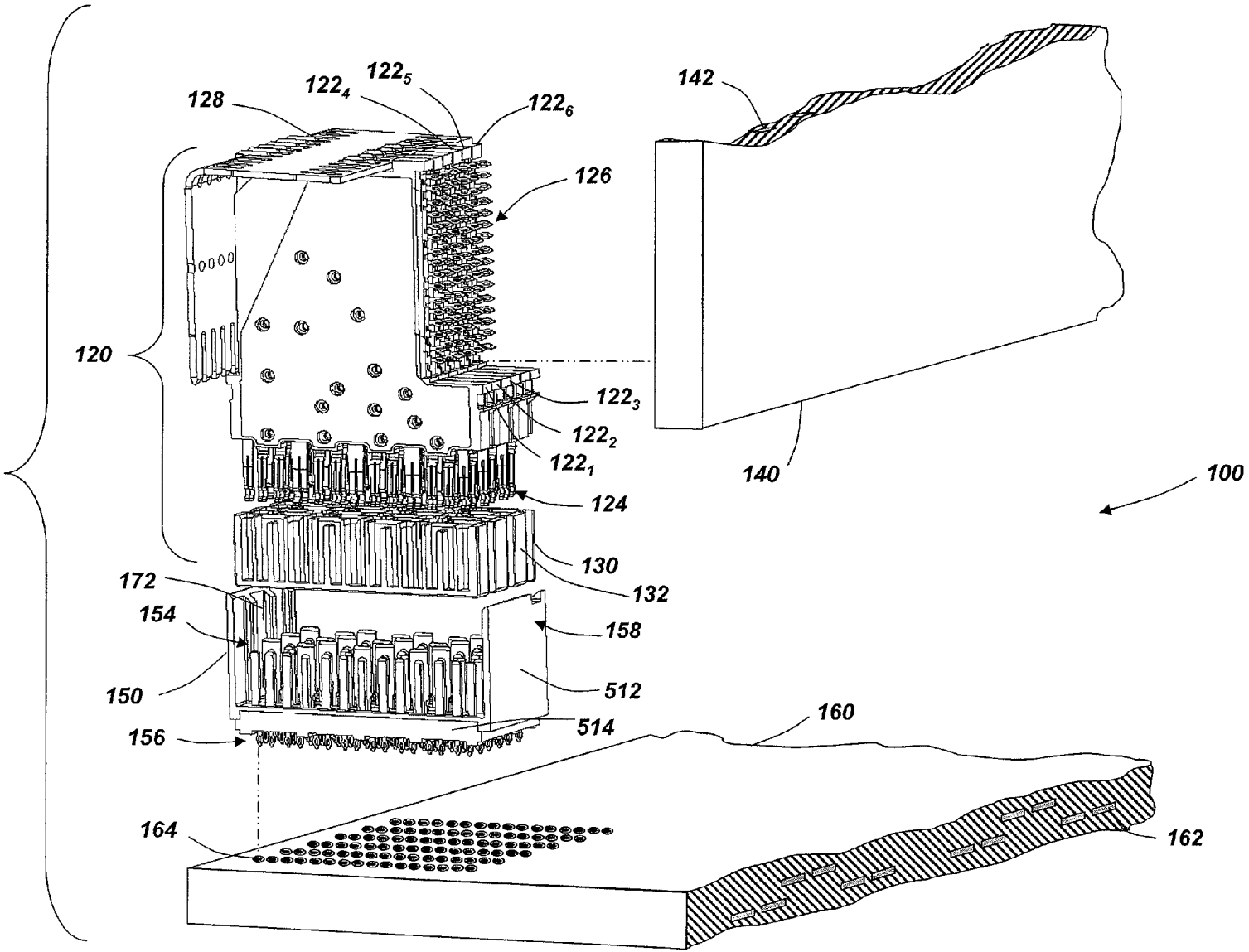
FIG. 1 is a perspective view of an electrical interconnection system according to an embodiment of the present invention.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," "having," "containing," or "involving," and variations thereof herein, is meant to encompass the items listed thereafter and equivalents thereof as well as additional items.

Referring to FIG. 1, an electrical interconnection system 100 with two connectors is shown. The electrical interconnection system 100 includes a daughter card connector 120 and a backplane connector 150.

Daughter card connector 120 is designed to mate with backplane connector 150, creating electronically conducting paths between backplane 160 and daughter card 140. Though not expressly shown, interconnection system 100 may interconnect multiple daughter cards having similar daughter card connectors that mate to similar backplane connections on backplane 160. Accordingly, the number and type of subassemblies connected through an interconnection system is not a limitation on the invention.

FIG. 1 shows an interconnection system using a right-angle, backplane connector. It should be appreciated that in other embodiments, the electrical interconnection system 100 may include other types and combinations of connectors, as the invention may be broadly applied in many types of electrical connectors, such as right angle connectors, mezzanine connectors, card edge connectors and chip sockets.

Backplane connector 150 and daughter connector 120 each contains conductive elements. The conductive elements of daughter card connector 120 are coupled to traces, of which trace 142 is numbered, ground planes or other conductive elements within daughter card 140. The traces carry electrical signals and the ground planes provide reference levels for components on daughter card 140. Ground planes may have voltages that are at earth ground or positive or negative with respect to earth ground, as any voltage level may act as a reference level.

Similarly, conductive elements in backplane connector 150 are coupled to traces, of which trace 162 is numbered, ground planes or other conductive elements within backplane 160. When daughter card connector 120 and backplane connector 150 mate, conductive elements in the two connectors mate to complete electrically conductive paths between the conductive elements within backplane 160 and daughter card 140.

Figure 6C:
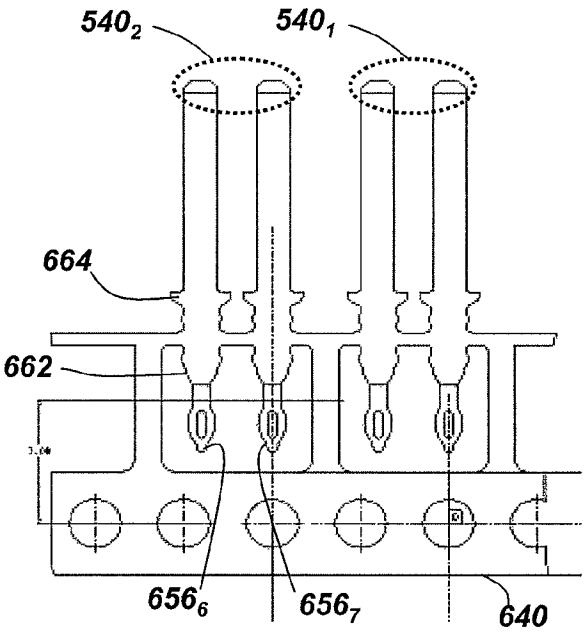
FIGS. 6A-6C are enlarged detail views of conductors used in the manufacture of a backplane connector according to an embodiment of the present invention.
Figure 6B:
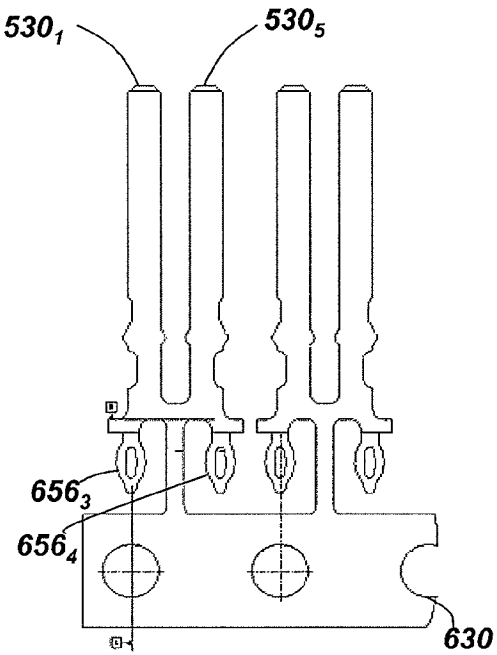
Figure 6A:
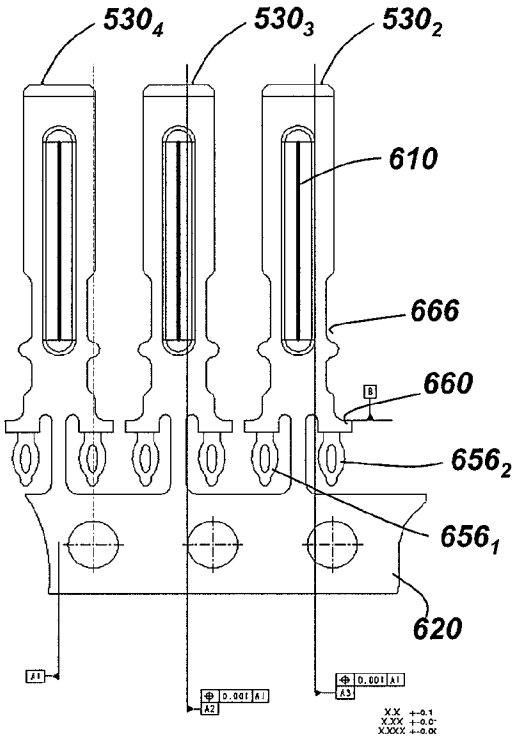

Backplane connector 150 includes a backplane shroud 158 and a plurality conductive elements (see FIGS. 6A-6C). The conductive elements of backplane connector 150 extend through floor 514 of the backplane shroud 158 with portions both above and below floor 514. Here, the portions of the conductive elements that extend above floor 514 form mating contacts, shown collectively as mating contact portions 154, which are adapted to mate to corresponding conductive elements of daughter card connector 120. In the illustrated embodiment, mating contacts 154 are in the form of blades, although other suitable contact configurations may be employed, as the present invention is not limited in this regard.

Tail portions, shown collectively as contact tails 156, of the conductive elements extend below the shroud floor 514 and are adapted to be attached to backplane 160. Here, the tail portions are in the form of a press fit, "eye of the needle" compliant sections that fit within via holes, shown collectively as via holes 164, on backplane 160. However, other configurations are also suitable, such as surface mount elements, spring contacts, solderable pins, etc., as the present invention is not limited in this regard.

In the embodiment illustrated, backplane shroud 158 is molded from a dielectric material such as plastic or nylon. Examples of suitable materials are liquid crystal polymer (LCP), polyphenyline sulfide (PPS), high temperature nylon or polypropylene (PPO). Other suitable materials may be employed, as the present invention is not limited in this regard. All of these are suitable for use as binder materials in manufacturing connectors according to the invention. One or more fillers may be included in some or all of the binder material used to form backplane shroud 158 to control the electrical or mechanical properties of backplane shroud 150. For example, thermoplastic PPS filled to 30% by volume with glass fiber may be used to form shroud 158.

In the embodiment illustrated, backplane connector 150 is manufactured by molding backplane shroud 158 with openings to receive conductive elements. The conductive elements may be shaped with barbs or other retention features that hold the conductive elements in place when inserted in the opening of backplane shroud 158.

Figure 5A:
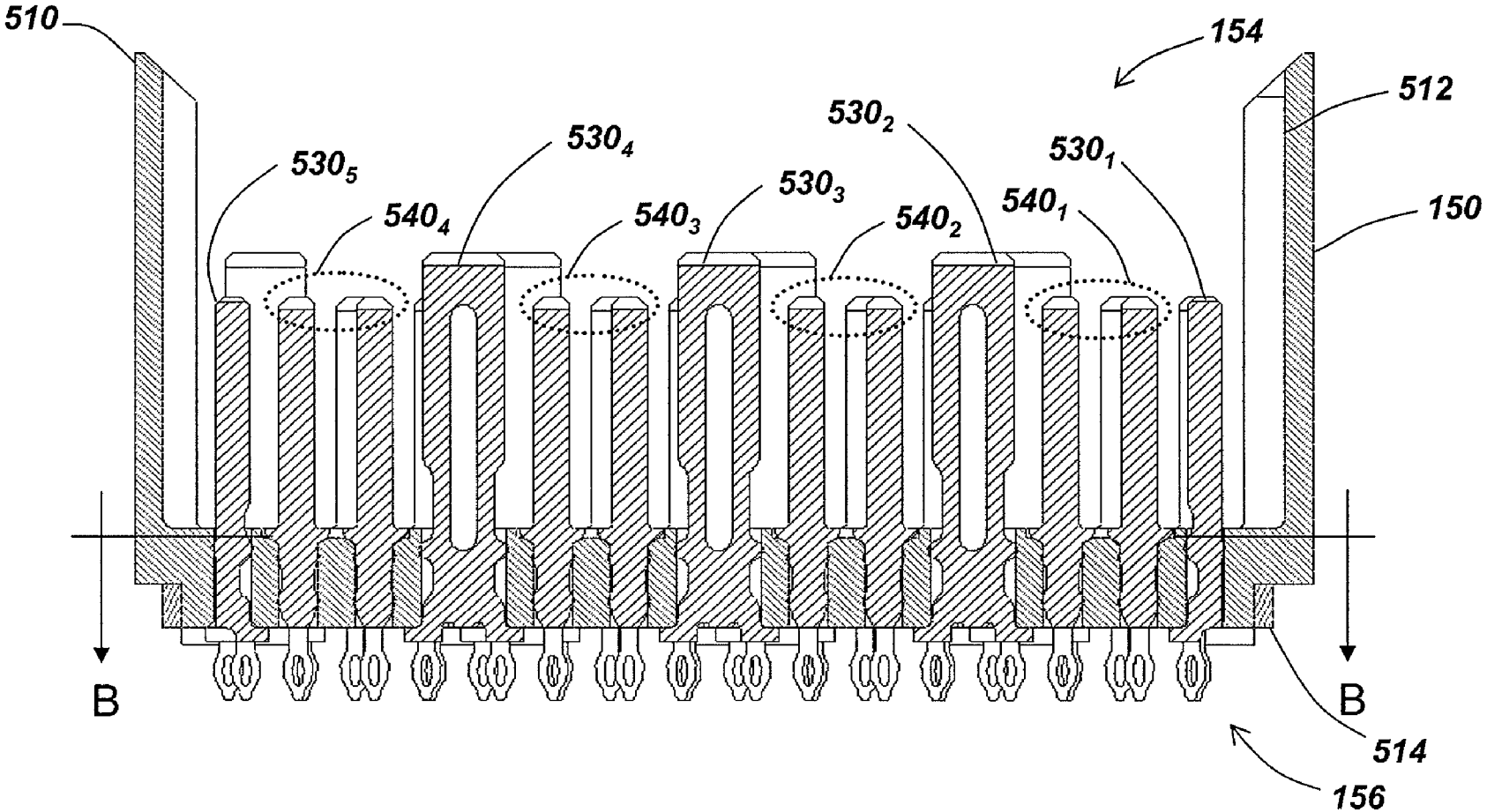
FIG. 5A is a cross-sectional representation of a backplane connector according to an embodiment of the present invention.

As shown in FIG. 1 and FIG. 5A, the backplane shroud 158 further includes side walls 512 that extend along the length of opposing sides of the backplane shroud 158. The side walls 512 include grooves 172, which run vertically along an inner surface of the side walls 512. Grooves 172 serve to guide front housing 130 of daughter card connector 120 via mating projections 132 into the appropriate position in shroud 158.

Daughter card connector 120 includes a plurality of wafers $\mathbf{122}_1 \ldots \mathbf{122}_6$ coupled together, with each of the plurality of wafers $\mathbf{122}_1 \ldots \mathbf{122}_6$ having a housing 260 (see FIGS. 2A-2C) and a column of conductive elements. In the illustrated embodiment, each column has a plurality of signal conductors 420 (see FIG. 4A) and a plurality of ground conductors 430 (see FIG. 4A). The ground conductors may be employed within each wafer $\mathbf{122}_1 \ldots \mathbf{122}_6$ to minimize crosstalk between signal conductors or to otherwise control the electrical properties of the connector.

Wafers $\mathbf{122}_1 \ldots \mathbf{122}_6$ may be formed by molding housing 260 around conductive elements that form signal and ground conductors. As with shroud 158 of backplane connector 150, housing 260 may be formed of any suitable material and may include portions that have conductive filler or are otherwise made lossy.

In the illustrated embodiment, daughter card connector 120 is a right angle connector and has conductive elements that traverse a right angle. As a result, opposing ends of the conductive elements extend from perpendicular edges of the wafers $\mathbf{122}_1 \ldots \mathbf{122}_6$.

Each conductive element of wafers $\mathbf{122}_1 \ldots \mathbf{122}_6$ has at least one contact tail, shown collectively as contact tails 126 that can be connected to daughter card 140. Each conductive element in daughter card connector 120 also has a mating contact portion, shown collectively as mating contacts 124, which can be connected to a corresponding conductive element in backplane connector 150. Each conductive element also has an intermediate portion between the mating contact portion and the contact tail, which may be enclosed by or embedded within a wafer housing 260 (see FIG. 2).

The contact tails 126 electrically connect the conductive elements within daughter card and connector 120 to conductive elements, such as traces 142 in daughter card 140. In the embodiment illustrated, contact tails 126 are press fit "eye of the needle" contacts that make an electrical connection through via holes in daughter card 140. However, any suitable attachment mechanism may be used instead of or in addition to via holes and press fit contact tails.

In the illustrated embodiment, each of the mating contacts 124 has a dual beam structure configured to mate to a corresponding mating contact 154 of backplane connector 150. The conductive elements acting as signal conductors may be grouped in pairs, separated by ground conductors in a configuration suitable for use as a differential electrical connector. However, embodiments are possible for single-ended use in which the conductive elements are evenly spaced without designated ground conductors separating signal conductors or with a ground conductor between each signal conductor.

In the embodiments illustrated, some conductive elements are designated as forming a differential pair of conductors and some conductive elements are designated as ground conductors. These designations refer to the intended use of the conductive elements in an interconnection system as they would be understood by one of skill in the art. For example, though other uses of the conductive elements may be possible, differential pairs may be identified based on preferential coupling between the conductive elements that make up the pair. Electrical characteristics of the pair, such as its impedance, that make it suitable for carrying a differential signal may provide an alternative or additional method of identifying a differential pair. As another example, in a connector with differential pairs, ground conductors may be identified by their positioning relative to the differential pairs. In other instances, ground conductors may be identified by their shape or electrical characteristics. For example, ground conductors may be relatively wide to provide low inductance, which is desirable for providing a stable reference potential, but provides an impedance that is undesirable for carrying a high speed signal.

For exemplary purposes only, daughter card connector 120 is illustrated with six wafers $\mathbf{122}_1 \ldots \mathbf{122}_6$, with each wafer having a plurality of pairs of signal conductors and adjacent ground conductors. As pictured, each of the wafers $\mathbf{122}_1 \ldots \mathbf{122}_6$ includes one column of conductive elements. However, the present invention is not limited in this regard, as the number of wafers and the number of signal conductors and ground conductors in each wafer may be varied as desired.

As shown, each wafer $\mathbf{122}_1 \ldots \mathbf{122}_6$ is inserted into front housing 130 such that mating contacts 124 are inserted into and held within openings in front housing 130. The openings in front housing 130 are positioned so as to allow mating contacts 154 of the backplane connector 150 to enter the openings in front housing 130 and allow electrical connection with mating contacts 124 when daughter card connector 120 is mated to backplane connector 150.

Daughter card connector 120 may include a support member instead of or in addition to front housing 130 to hold wafers $\mathbf{122}_1 \ldots \mathbf{122}_6$. In the pictured embodiment, stiffener 128 supports the plurality of wafers $\mathbf{122}_1 \ldots \mathbf{122}_6$. Stiffener 128 is, in the embodiment illustrated, a stamped metal member. Though, stiffener 128 may be formed from any suitable material. Stiffener 128 may be stamped with slots, holes, grooves or other features that can engage a wafer.

Each wafer $\mathbf{122}_1 \ldots \mathbf{122}_6$ may include attachment features 242, 244 (see FIGS. 2A-2B) that engage stiffener 128 to locate each wafer 122 with respect to another and further to prevent rotation of the wafer 122. Of course, the present invention is not limited in this regard, and no stiffener need be employed. Further, although the stiffener is shown attached to an upper and side portion of the plurality of wafers, the present invention is not limited in this respect, as other suitable locations may be employed.

Figure 2B:
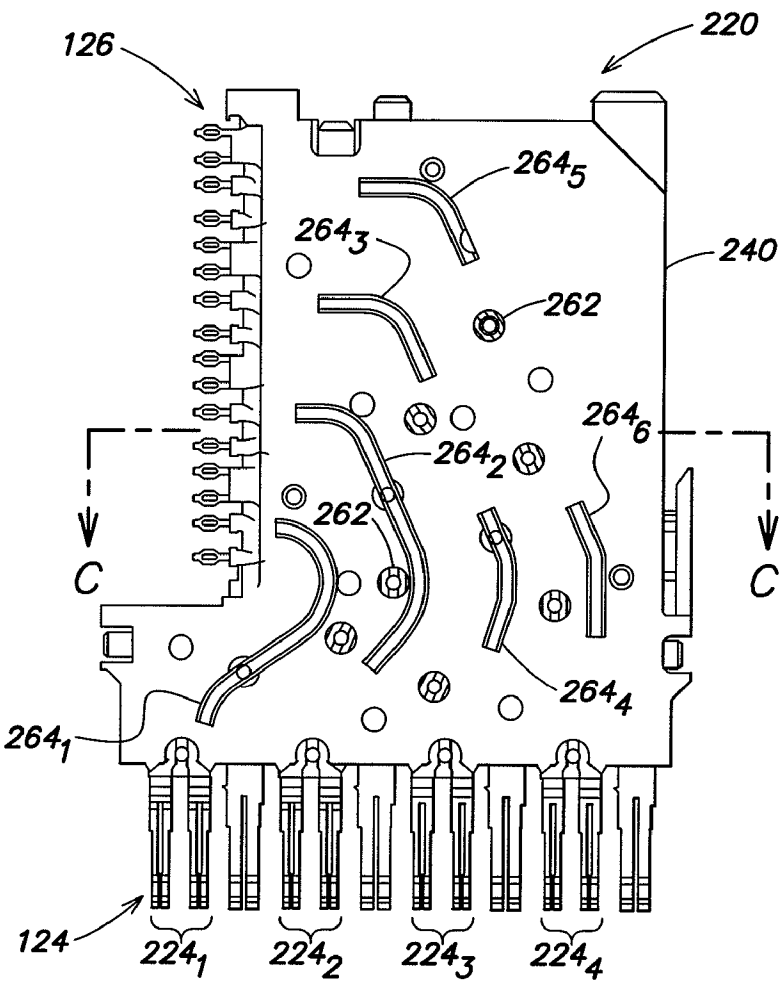
FIGS. 2A and 2B are views of a first and second side of a wafer forming a portion of the electrical connector of FIG. 1.
Figure 2A:
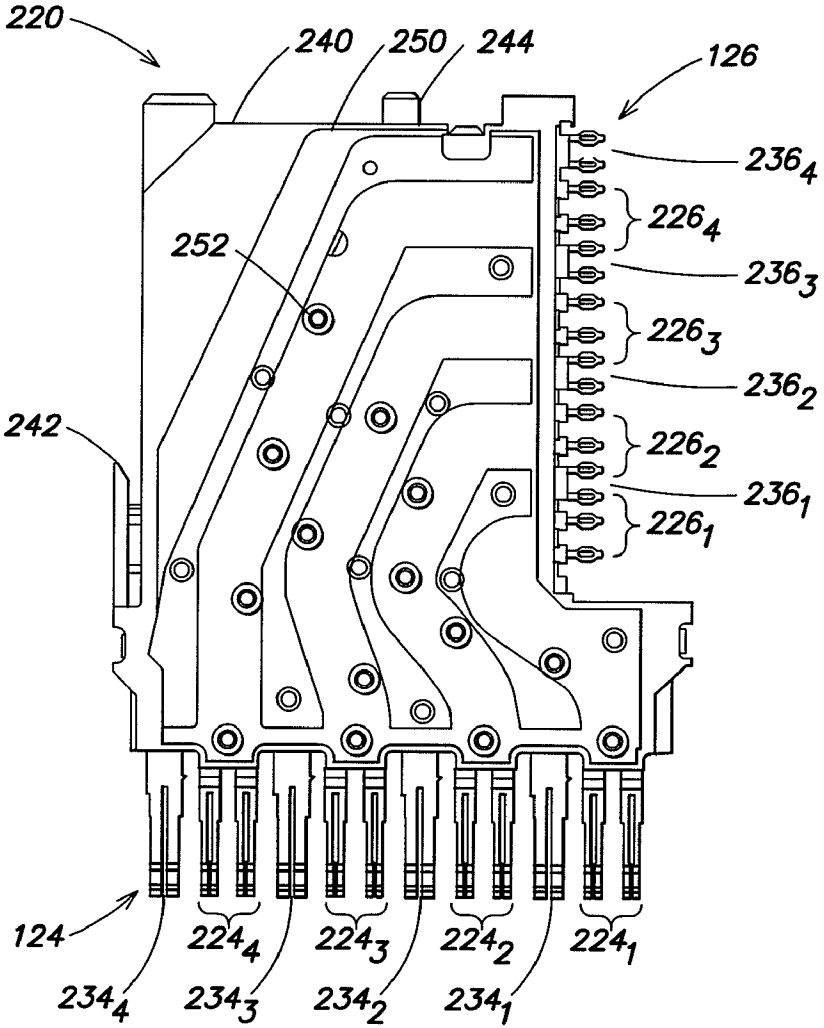

FIGS. 2A-2B illustrate opposing side views of an exemplary wafer 220A. Wafer 220A may be formed in whole or in part by injection molding of material to form housing 260 around a wafer strip assembly such as 410A or 410B (FIG. 4). In the pictured embodiment, wafer 220A is formed with a two shot molding operation, allowing housing 260 to be formed of two types of material having different material properties. Insulative portion 240 is formed in a first shot and lossy portion 250 is formed in a second shot. However, any suitable number and types of material may be used in housing 260. In one embodiment, the housing 260 is formed around a column of conductive elements by injection molding plastic.

In some embodiments, housing 260 may be provided with openings, such as windows or slots $\mathbf{264}_1 \ldots \mathbf{264}_6$, and holes, of which hole 262 is numbered, adjacent the signal conductors 420. These openings may serve multiple purposes, including to: (i) ensure during an injection molding process that the conductive elements are properly positioned, and (ii) facilitate insertion of materials that have different electrical properties, if so desired.

To obtain the desired performance characteristics, one embodiment of the present invention may employ regions of different dielectric constant selectively located adjacent signal conductors $\mathbf{310}_1$B, $\mathbf{310}_2$B . . . $\mathbf{310}_4$B of a wafer. For example, in the embodiment illustrated in FIGS. 2A-2C, the housing 260 includes slots $\mathbf{264}_1 \ldots \mathbf{264}_6$ in housing 260 that position air adjacent signal conductors $\mathbf{310}_1$B, $\mathbf{310}_2$B . . . $\mathbf{310}_4$B.

The ability to place air, or other material that has a dielectric constant lower than the dielectric constant of material used to form other portions of housing 260, in close proximity to one half of a differential pair provides a mechanism to de-skew a differential pair of signal conductors. The time it takes an electrical signal to propagate from one end of the signal connector to the other end is known as the propagation delay. In some embodiments, it is desirable that each signal within a pair have the same propagation delay, which is commonly referred to as having zero skew within the pair. The propagation delay within a conductor is influenced by the dielectric constant of material near the conductor, where a lower dielectric constant means a lower propagation delay. The dielectric constant is also sometimes referred to as the relative permittivity. A vacuum has the lowest possible dielectric constant with a value of 1. Air has a similarly low dielectric constant, whereas dielectric materials, such as LCP, have higher dielectric constants. For example, LCP has a dielectric constant of between about 2.5 and about 4.5.

Each signal conductor of the signal pair may have a different physical length, particularly in a right-angle connector. According to one aspect of the invention, to equalize the propagation delay in the signal conductors of a differential pair even though they have physically different lengths, the relative proportion of materials of different dielectric constants around the conductors may be adjusted. In some embodiments, more air is positioned in close proximity to the physically longer signal conductor of the pair than for the shorter signal conductor of the pair, thus lowering the effective dielectric constant around the signal conductor and decreasing its propagation delay.

However, as the dielectric constant is lowered, the impedance of the signal conductor rises. To maintain balanced impedance within the pair, the size of the signal conductor in closer proximity to the air may be increased in thickness or width. This results in two signal conductors with different physical geometry, but a more equal propagation delay and more inform impedance profile along the pair.

Figure 2C:
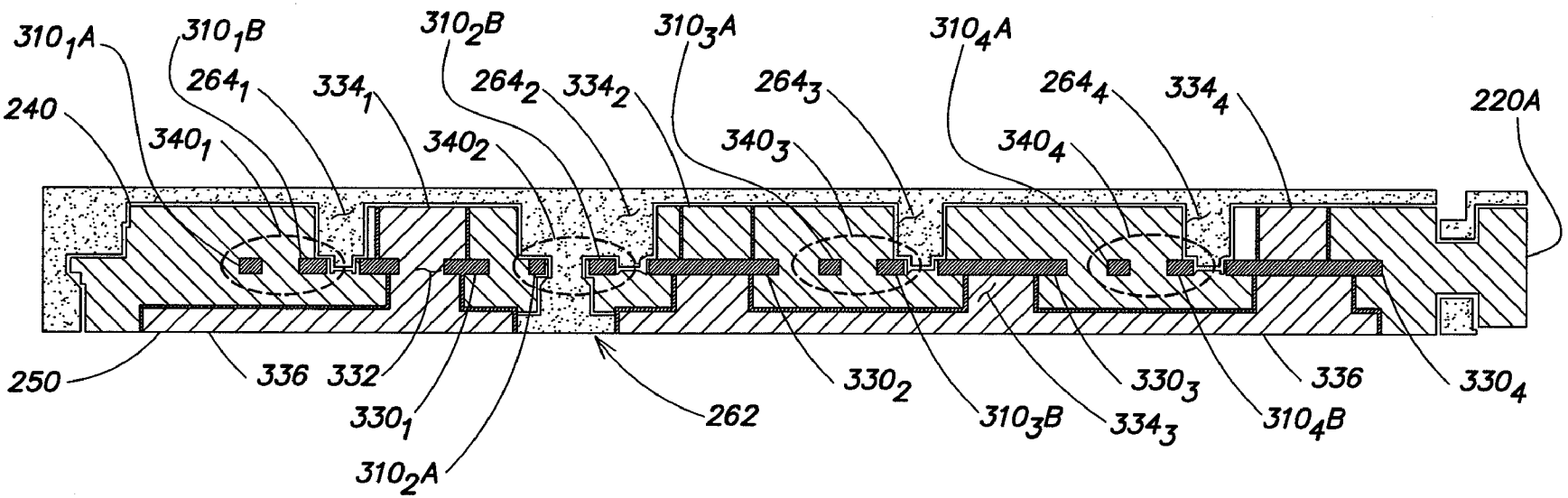
FIG. 2C is a cross-sectional representation of the wafer illustrated in FIG. 2B taken along the line 2C-2C.

FIG. 2C shows a wafer 220 in cross section taken along the line 2C-2C in FIG. 2B. As shown, a plurality of differential pairs $\mathbf{340}_1 \ldots \mathbf{340}_4$ are held in an array within insulative portion 240 of housing 260. In the illustrated embodiment, the array, in cross-section, is a linear array, forming a column of conductive elements.

Slots $\mathbf{264}_1 \ldots \mathbf{264}_4$ are intersected by the cross section and are therefore visible in FIG. 2C. As can be seen, slots $\mathbf{264}_1 \ldots \mathbf{264}_4$ create regions of air adjacent the longer conductor in each differential pair $\mathbf{340}_1, \mathbf{340}_2 \ldots \mathbf{340}_4$. Though, air is only one example of a material with a low dielectric constant that may be used for de-skewing a connector. Regions comparable to those occupied by slots $\mathbf{264}_1 \ldots \mathbf{264}_4$ as shown in FIG. 2C could be formed with a plastic with a lower dielectric constant than the plastic used to form other portions of housing 260. As another example, regions of lower dielectric constant could be formed using different types or amounts of fillers. For example, lower dielectric constant regions could be molded from plastic having less glass fiber reinforcement than in other regions.

FIG. 2C also illustrates positioning and relative dimensions of signal and ground conductors that may be used in some embodiments. As shown in FIG. 2C, intermediate portions of the signal conductors $\mathbf{310}_1$A . . . $\mathbf{310}_4$A and $\mathbf{310}_1$B . . . $\mathbf{310}_4$B are embedded within housing 260 to form a column. Intermediate portions of ground conductors $\mathbf{330}_1 \ldots \mathbf{330}_4$ may also be held within housing 260 in the same column.

Ground conductors $\mathbf{330}_1$, $\mathbf{330}_2$ and $\mathbf{330}_3$ are positioned between two adjacent differential pairs $\mathbf{340}_1, \mathbf{340}_2 \ldots \mathbf{340}_4$ within the column. Additional ground conductors may be included at either or both ends of the column. In wafer 220A, as illustrated in FIG. 2C, a ground conductor $\mathbf{330}_4$ is positioned at one end of the column. As shown in FIG. 2C, in some embodiments, each ground conductor $\mathbf{330}_1 \ldots \mathbf{330}_4$ is preferably wider than the signal conductors of differential pairs $\mathbf{340}_1 \ldots \mathbf{340}_4$. In the cross-section illustrated, the intermediate portion of each ground conductor has a width that is equal to or greater than three times the width of the intermediate portion of a signal conductor. In the pictured embodiment, the width of each ground conductor is sufficient to span at least the same distance along the column as a differential pair.

In the pictured embodiment, each ground conductor has a width approximately five times the width of a signal conductor such that in excess of 50% of the column width occupied by the conductive elements is occupied by the ground conductors. In the illustrated embodiment, approximately 70% of the column width occupied by conductive elements is occupied by the ground conductors $\mathbf{330}_1 \ldots \mathbf{330}_4$. Increasing the percentage of each column occupied by a ground conductor can decrease cross talk within the connector.

Other techniques can also be used to manufacture wafer 220A to reduce crosstalk or otherwise have desirable electrical properties. In some embodiments, one or more portions of the housing 260 are formed from a material that selectively alters the electrical and/or electromagnetic properties of that portion of the housing, thereby suppressing noise and/or crosstalk, altering the impedance of the signal conductors or otherwise imparting desirable electrical properties to the signal conductors of the wafer.

In the embodiment illustrated in FIGS. 2A-2C, housing 260 includes an insulative portion 240 and a lossy portion 250. In one embodiment, the lossy portion 250 may include a thermoplastic material filled with conducting particles. The fillers make the portion "electrically lossy." In one embodiment, the lossy regions of the housing are configured to reduce crosstalk between at least two adjacent differential pairs $\mathbf{340}_1 \ldots \mathbf{340}_4$. The insulative regions of the housing may be configured so that the lossy regions do not attenuate signals carried by the differential pairs $\mathbf{340}_1 \ldots \mathbf{340}_4$ an undesirable amount.

Materials that conduct, but with some loss, over the frequency range of interest are referred to herein generally as "lossy" materials. Electrically lossy materials can be formed from lossy dielectric and/or lossy conductive materials. The frequency range of interest depends on the operating parameters of the system in which such a connector is used, but will generally be between about 1 GHz and 25 GHz, though higher frequencies or lower frequencies may be of interest in some applications. Some connector designs may have frequency ranges of interest that span only a portion of this range, such as 1 to 10 GHz or 3 to 15 GHz or 3 to 6 GHz.

Electrically lossy material can be formed from material traditionally regarded as dielectric materials, such as those that have an electric loss tangent greater than approximately 0.003 in the frequency range of interest. The "electric loss tangent" is the ratio of the imaginary part to the real part of the complex electrical permittivity of the material.

Electrically lossy materials can also be formed from materials that are generally thought of as conductors, but are either relatively poor conductors over the frequency range of interest, contain particles or regions that are sufficiently dispersed that they do not provide high conductivity or otherwise are prepared with properties that lead to a relatively weak bulk conductivity over the frequency range of interest. Electrically lossy materials typically have a conductivity of about 1 siemans/meter to about $6.1\times10^7$ siemans/meter, preferably about 1 siemans/meter to about $1\times10^7$ siemans/meter and most preferably about 1 siemans/meter to about 30,000 siemans/meter.

Electrically lossy materials may be partially conductive materials, such as those that have a surface resistivity between 1 Ω/square and $10^6$ Ω/square. In some embodiments, the electrically lossy material has a surface resistivity between 1 Ω/square and $10^3$ Ω/square. In some embodiments, the electrically lossy material has a surface resistivity between 10 Ω/square and 100 Ω/square. As a specific example, the material may have a surface resistivity of between about 20 Ω/square and 40 Ω/square.

In some embodiments, electrically lossy material is formed by adding to a binder a filler that contains conductive particles. Examples of conductive particles that may be used as a filler to form an electrically lossy material include carbon or graphite formed as fibers, flakes or other particles. Metal in the form of powder, flakes, fibers or other particles may also be used to provide suitable electrically lossy properties. Alternatively, combinations of fillers may be used. For example, metal plated carbon particles may be used. Silver and nickel are suitable metal plating for fibers. Coated particles may be used alone or in combination with other fillers, such as carbon flake. In some embodiments, the conductive particles disposed in the lossy portion 250 of the housing may be disposed generally evenly throughout, rendering a conductivity of the lossy portion generally constant. An other embodiments, a first region of the lossy portion 250 may be more conductive than a second region of the lossy portion 250 so that the conductivity, and therefore amount of loss within the lossy portion 250 may vary.

The binder or matrix may be any material that will set, cure or can otherwise be used to position the filler material. In some embodiments, the binder may be a thermoplastic material such as is traditionally used in the manufacture of electrical connectors to facilitate the molding of the electrically lossy material into the desired shapes and locations as part of the manufacture of the electrical connector. However, many alternative forms of binder materials may be used. Curable materials, such as epoxies, can serve as a binder. Alternatively, materials such as thermosetting resins or adhesives may be used. Also, while the above described binder materials may be used to create an electrically lossy material by forming a binder around conducting particle fillers, the invention is not so limited. For example, conducting particles may be impregnated into a formed matrix material or may be coated onto a formed matrix material, such as by applying a conductive coating to a plastic housing. As used herein, the term "binder" encompasses a material that encapsulates the filler, is impregnated with the filler or otherwise serves as a substrate to hold the filler.

Preferably, the fillers will be present in a sufficient volume percentage to allow conducting paths to be created from particle to particle. For example, when metal fiber is used, the fiber may be present in about 3% to 40% by volume. The amount of filler may impact the conducting properties of the material.

Filled materials may be purchased commercially, such as materials sold under the trade name Celestran® by Ticona. A lossy material, such as lossy conductive carbon filled adhesive preform, such as those sold by Techfilm of Billerica, Mass., US may also be used. This preform can include an epoxy binder filled with carbon particles. The binder surrounds carbon particles, which acts as a reinforcement for the preform. Such a preform may be inserted in a wafer 220A to form all or part of the housing and may be positioned to adhere to ground conductors in the wafer. In some embodiments, the preform may adhere through the adhesive in the preform, which may be cured in a heat treating process. Various forms of reinforcing fiber, in woven or non-woven form, coated or non-coated may be used. Non-woven carbon fiber is one suitable material. Other suitable materials, such as custom blends as sold by RTP Company, can be employed, as the present invention is not limited in this respect.

In the embodiment illustrated in FIG. 2C, the wafer housing 260 is molded with two types of material. In the pictured embodiment, lossy portion 250 is formed of a material having a conductive filler, whereas the insulative portion 240 is formed from an insulative material having little or no conductive fillers, though insulative portions may have fillers, such as glass fiber, that alter mechanical properties of the binder material or impacts other electrical properties, such as dielectric constant, of the binder. In one embodiment, the insulative portion 240 is formed of molded plastic and the lossy portion is formed of molded plastic with conductive fillers. In some embodiments, the lossy portion 250 is sufficiently lossy that it attenuates radiation between differential pairs to a sufficient amount that crosstalk is reduced to a level that a separate metal plate is not required.

To prevent signal conductors $\mathbf{310}_1$A, $\mathbf{310}_1$B . . . $\mathbf{310}_4$A, and $\mathbf{310}_4$B from being shorted together and/or from being shorted to ground by lossy portion 250, insulative portion 240, formed of a suitable dielectric material, may be used to insulate the signal conductors. The insulative materials may be, for example, a thermoplastic binder into which non-conducting fibers are introduced for added strength, dimensional stability and to reduce the amount of higher priced binder used. Glass fibers, as in a conventional electrical connector, may have a loading of about 30% by volume. It should be appreciated that in other embodiments, other materials may be used, as the invention is not so limited.

In the embodiment of FIG. 2C, the lossy portion 250 includes a parallel region 336 and perpendicular regions $\mathbf{334}_1$ . . . $\mathbf{334}_4$. In one embodiment, perpendicular regions $\mathbf{334}_1$ . . . $\mathbf{334}_4$ are disposed between adjacent conductive elements that form separate differential pairs $\mathbf{340}_1$ . . . $\mathbf{340}_4$.

In some embodiments, the lossy regions 336 and $\mathbf{334}_1$ . . . $\mathbf{334}_4$ of the housing 260 and the ground conductors $\mathbf{330}_1$ . . . $\mathbf{330}_4$ cooperate to shield the differential pairs $\mathbf{340}_1$ . . . $\mathbf{340}_4$ to reduce crosstalk. The lossy regions 336 and $\mathbf{334}_1$ . . . $\mathbf{334}_4$ may be grounded by being electrically connected to one or more ground conductors. This configuration of lossy material in combination with ground conductors $\mathbf{330}_1$ . . . $\mathbf{330}_4$ reduces crosstalk between differential pairs within a column.

As shown in FIG. 2C, portions of the ground conductors $\mathbf{330}_1$ . . . $\mathbf{330}_4$, may be electrically connected to regions 336 and $\mathbf{334}_1$ . . . $\mathbf{334}_4$ by molding portion 250 around ground conductors $\mathbf{340}_1$ . . . $\mathbf{340}_4$. In some embodiments, ground conductors may include openings through which the material forming the housing can flow during molding. For example, the cross section illustrated in FIG. 2C is taken through an opening 332 in ground conductor $\mathbf{330}_1$ . Though not visible in the cross section of FIG. 2C, other openings in other ground conductors such as $\mathbf{330}_2$ . . . $\mathbf{330}_4$ may be included.

Material that flows through openings in the ground conductors allows perpendicular portions $\mathbf{334}_1$ . . . $\mathbf{334}_4$to extend through ground conductors even though a mold cavity used to form a wafer 220A has inlets on only one side of the ground conductors. Additionally, flowing material through openings in ground conductors as part of a molding operation may aid in securing the ground conductors in housing 260 and may enhance the electrical connection between the lossy portion 250 and the ground conductors. However, other suitable methods of forming perpendicular portions $\mathbf{334}_1$ . . . $\mathbf{334}_4$ may also be used, including molding wafer 320A in a cavity that has inlets on two sides of ground conductors $\mathbf{330}_1$ . . . $\mathbf{330}_4$. Likewise, other suitable methods for securing the ground contacts 330 may be employed, as the present invention is not limited in this respect.

Forming the lossy portion 250 of the housing from a moldable material can provide additional benefits. For example, the lossy material at one or more locations can be configured to set the performance of the connector at that location. For example, changing the thickness of a lossy portion to space signal conductors closer to or further away from the lossy portion 250 can alter the performance of the connector. As such, electromagnetic coupling between one differential pair and ground and another differential pair and ground can be altered, thereby configuring the amount of loss for radiation between adjacent differential pairs and the amount of loss to signals carried by those differential pairs. As a result, a connector according to embodiments of the invention may be capable of use at higher frequencies than conventional connectors, such as for example at frequencies between 10-15 GHz.

As shown in the embodiment of FIG. 2C, wafer 220A is designed to carry differential signals. Thus, each signal is carried by a pair of signal conductors $\mathbf{310}_1$A and $\mathbf{310}_1$B, . . . $\mathbf{310}_4$A, and $\mathbf{310}_4$B. Preferably, each signal conductor is closer to the other conductor in its pair than it is to a conductor in an adjacent pair. For example, a pair $\mathbf{340}_1$ carries one differential signal, and pair $\mathbf{340}_2$ carries another differential signal. As can be seen in the cross section of FIG. 2C, signal conductor $\mathbf{310}_1$B is closer to signal conductor 310A than to signal conductor $\mathbf{310}_2$A. Perpendicular lossy regions $\mathbf{334}_1$ . . . $\mathbf{334}_4$ may be positioned between pairs to provide shielding between the adjacent differential pairs in the same column.

Figure 3:
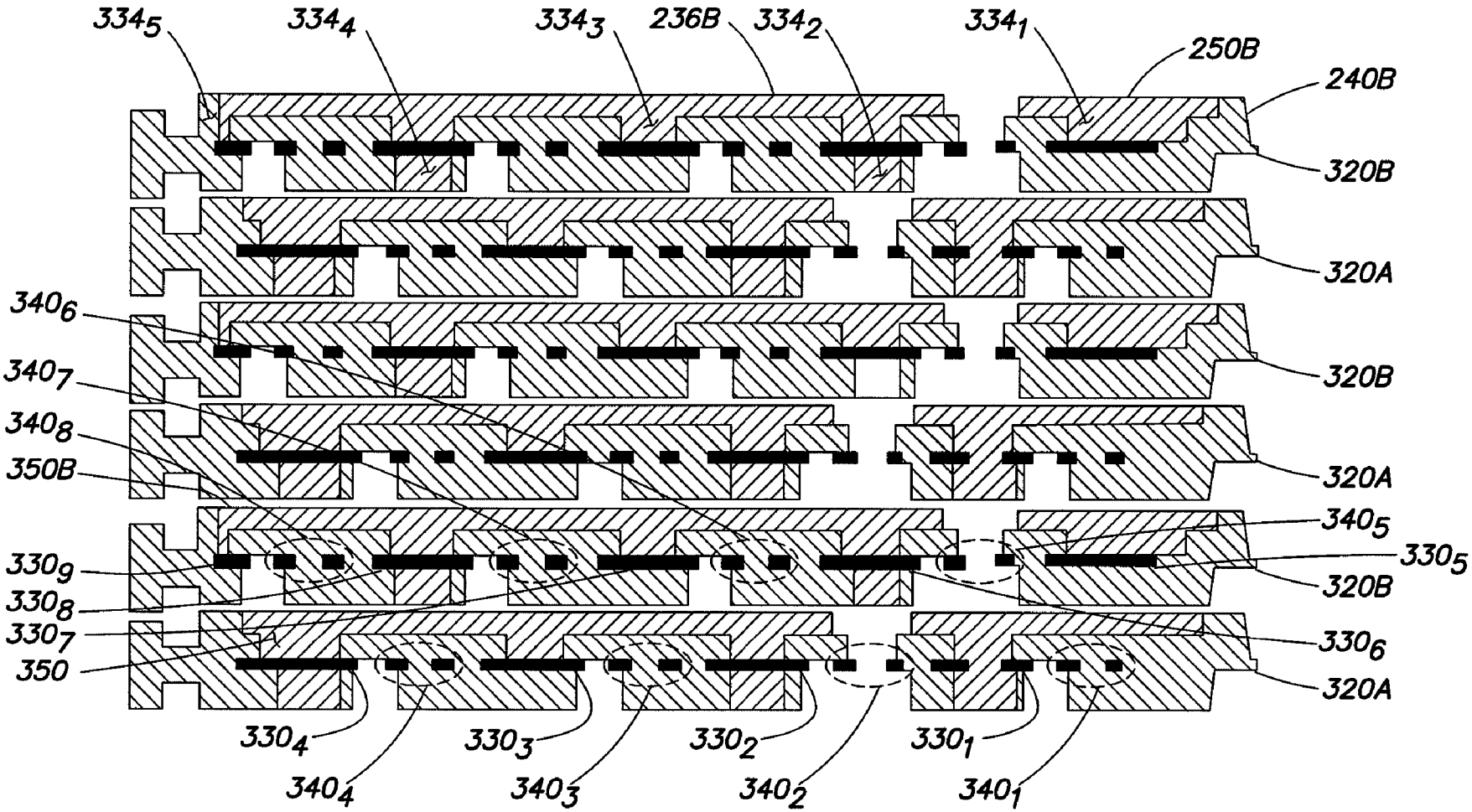
FIG. 3 is a cross-sectional representation of a plurality of wafers stacked together according to an embodiment of the present invention.

Lossy material may also be positioned to reduce the crosstalk between adjacent pairs in different columns. FIG. 3 illustrates a cross-sectional view similar to FIG. 2C but with a plurality of subassemblies or wafers 320A, 320B aligned side to side to form multiple parallel columns.

As illustrated in FIG. 3, the plurality of signal conductors 340 may be arranged in differential pairs in a plurality of columns formed by positioning wafers side by side. It is not necessary that each wafer be the same and different types of wafers may be used.

It may be desirable for all types of wafers used to construct a daughter card connector to have an outer envelope of approximately the same dimensions so that all wafers fit within the same enclosure or can be attached to the same support member, such as stiffener 128 (FIG. 1). However, by providing different placement of the signal conductors, ground conductors and lossy portions in different wafers, the amount that the lossy material reduces crosstalk relative for the amount that it attenuates signals may be more readily configured. In one embodiment, two types of wafers are used, which are illustrated in FIG. 3 as subassemblies or wafers 320A and 320B.

Each of the wafers 320B may include structures similar to those in wafer 320A as illustrated in FIGS. 2A, 2B and 2C. As shown in FIG. 3, wafers 320B include multiple differential pairs, such as pairs 3405, 3406, 3407 and 3408. The signal pairs may be held within an insulative portion, such as 240B of a housing. Slots or other structures, not numbered) may be formed within the housing for skew equalization in the same way that slots $\mathbf{264}_1 \ldots \mathbf{264}_6$ are formed in a wafer 220A.

The housing for a wafer 320B may also include lossy portions, such as lossy portions 250B. As with lossy portions 250 described in connection with wafer 320A in FIG. 2C, lossy portions 250B may be positioned to reduce crosstalk between adjacent differential pairs. The lossy portions 250B may be shaped to provide a desirable level of crosstalk suppression without causing an undesired amount of signal attenuation.

In the embodiment illustrated, lossy portion 250B may have a substantially parallel region 336B that is parallel to the columns of differential pairs $\mathbf{340}_5 \ldots \mathbf{340}_8$. Each lossy portion 250B may further include a plurality of perpendicular regions $\mathbf{334}_1$B . . . $\mathbf{334}_5$B, which extend from the parallel region 336B. The perpendicular regions $\mathbf{334}_1$B . . . $\mathbf{334}_5$B may be spaced apart and disposed between adjacent differential pairs within a column.

Wafers 320B also include ground conductors, such as ground conductors $\mathbf{330}_5 \ldots \mathbf{330}_9$. As with wafers 320A, the ground conductors are positioned adjacent differential pairs $\mathbf{340}_5 \ldots \mathbf{340}_8$. Also, as in wafers 320A, the ground conductors generally have a width greater than the width of the signal conductors. In the embodiment pictured in FIG. 3, ground conductors $\mathbf{330}_5 \ldots \mathbf{330}_8$ have generally the same shape as ground conductors $\mathbf{330}_1 \ldots \mathbf{330}_4$ in a wafer 320A. However, in the embodiment illustrated, ground conductor $\mathbf{330}_9$ has a width that is less than the ground conductors $\mathbf{330}_5 \ldots \mathbf{330}_8$ in wafer 320B.

Ground conductor $\mathbf{330}_9$ is narrower to provide desired electrical properties without requiring the wafer 320B to be undesirably wide. Ground conductor $\mathbf{330}_9$ has an edge facing differential pair $\mathbf{340}_8$. Accordingly, differential pair $\mathbf{340}_8$ is positioned relative to a ground conductor similarly to adjacent differential pairs, such as differential pair $\mathbf{330}_8$ in wafer 320B or pair $\mathbf{340}_4$ in a wafer 320A. As a result, the electrical properties of differential pair $\mathbf{340}_8$ are similar to those of other differential pairs. By making ground conductor $\mathbf{330}_9$ narrower than ground conductors $\mathbf{330}_8$ or $\mathbf{330}_4$, wafer 320B may be made with a smaller size.

A similar small ground conductor could be included in wafer 320A adjacent pair $\mathbf{340}_1$. However, in the embodiment illustrated, pair $\mathbf{340}_1$ is the shortest of all differential pairs within daughter card connector 120. Though including a narrow ground conductor in wafer 320A could make the ground configuration of differential pair $\mathbf{340}_1$ more similar to the configuration of adjacent differential pairs in wafers 320A and 320B, the net effect of differences in ground configuration may be proportional to the length of the conductor over which those differences exist. Because differential pair $\mathbf{340}_1$ is relatively short, in the embodiment of FIG. 3, a second ground conductor adjacent to differential pair $\mathbf{340}_1$, though it would change the electrical characteristics of that pair, may have relatively little net effect. However, in other embodiments, a further ground conductor may be included in wafers 320A.

FIG. 3 illustrates a further feature possible when using multiple types of wafers to form a daughter card connector. Because the columns of contacts in wafers 320A and 320B have different configurations, when wafer 320A is placed side by side with wafer 320B, the differential pairs in wafer 320A are more closely aligned with ground conductors in wafer 320B than with adjacent pairs of signal conductors in wafer 320B. Conversely, the differential pairs of wafer 320B are more closely aligned with ground conductors than adjacent differential pairs in the wafer 320A.

For example, differential pair $\mathbf{340}_6$ is proximate ground conductor $\mathbf{330}_2$ in wafer 320A. Similarly, differential pair $\mathbf{340}_3$ in wafer 320A is proximate ground conductor $\mathbf{330}_7$ in wafer 320B. In this way, radiation from a differential pair in one column couples more strongly to a ground conductor in an adjacent column than to a signal conductor in that column. This configuration reduces crosstalk between differential pairs in adjacent columns.

Wafers with different configurations may be formed in any suitable way. FIG. 4A illustrates a step in the manufacture of wafers 320A and 320B according to one embodiment. In the illustrated embodiment, wafer strip assemblies, each containing conductive elements in a configuration desired for one column of a daughter card connector, are formed. A housing is then molded around the conductive elements in each wafer strip assembly in an insert molding operation to form a wafer.

To facilitate the manufacture of wafers, signal conductors, of which signal conductor 420 is numbered and ground conductors, of which ground conductor 430 is numbered, may be held together on a lead frame 400 as shown in FIG. 4A. As shown, the signal conductors 420 and the ground conductors 430 are attached to one or more carrier strips 402. In one embodiment, the signal conductors and ground conductors are stamped for many wafers on a single sheet. The sheet may be metal or may be any other material that is conductive and provides suitable mechanical properties for making a conductive element in an electrical connector. Phosphor-bronze, beryllium copper and other copper alloys are example of materials that may be used.

FIG. 4A illustrates a portion of a sheet of metal in which wafer strip assemblies 410A, 410B have been stamped. Wafer strip assemblies 410A, 410B may be used to form wafers 320A and 320B, respectively. Conductive elements may be retained in a desired position on carrier strips 402. The conductive elements may then be more readily handled during manufacture of wafers. Once material is molded around the conductive elements, the carrier strips may be severed to separate the conductive elements. The wafers may then be assembled into daughter board connectors of any suitable size.

FIG. 4A also provides a more detailed view of features of the conductive elements of the daughter card wafers. The width of a ground conductor, such as ground conductor 430, relative to a signal conductor, such as signal conductor 420, is apparent. Also, openings in ground conductors, such as opening 332, are visible.

The wafer strip assemblies shown in FIG. 4A provide just one example of a component that may be used in the manufacture of wafers. For example, in the embodiment illustrated in FIG. 4A, the lead frame 400 includes tie bars 452, 454 and 456 that connect various portions of the signal conductors 420 and/or ground strips 430 to the lead frame 400. These tie bars may be severed during subsequent manufacturing processes to provide electronically separate conductive elements. A sheet of metal may be stamped such that one or more additional carrier strips are formed at other locations and/or bridging members between conductive elements may be employed for positioning and support of the conductive elements during manufacture. Accordingly, the details shown in FIG. 4A are illustrative and not a limitation on the invention.

Although the lead frame 400 is shown as including both ground conductors 430 and the signal conductors 420, the present invention is not limited in this respect. For example, the respective conductors may be formed in two separate lead frames. Indeed, no lead frame need be used and individual conductive elements may be employed during manufacture. It should be appreciated that molding over one or both lead frames or the individual conductive elements need not be performed at all, as the wafer may be assembled by inserting ground conductors and signal conductors into preformed housing portions, which may then be secured together with various features including snap fit features.

Figure 4B:
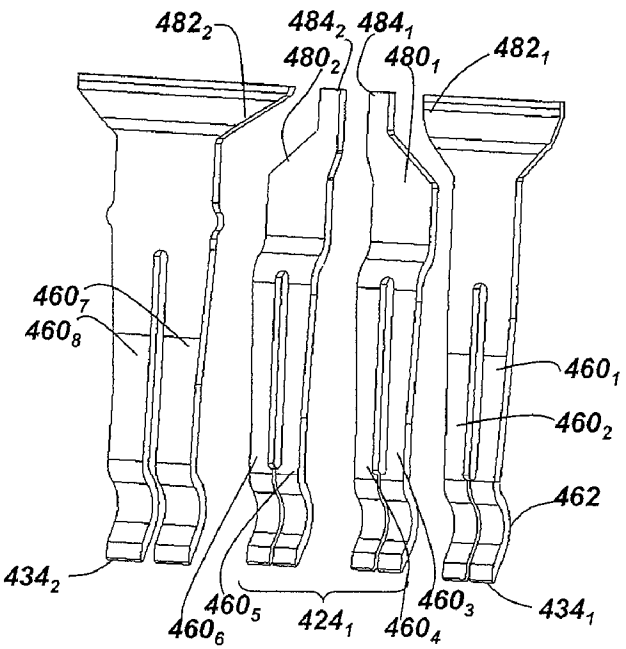
FIG. 4B is an enlarged detail view of the area encircled by arrow 4B-4B in FIG. 4A.
Figure 4A:
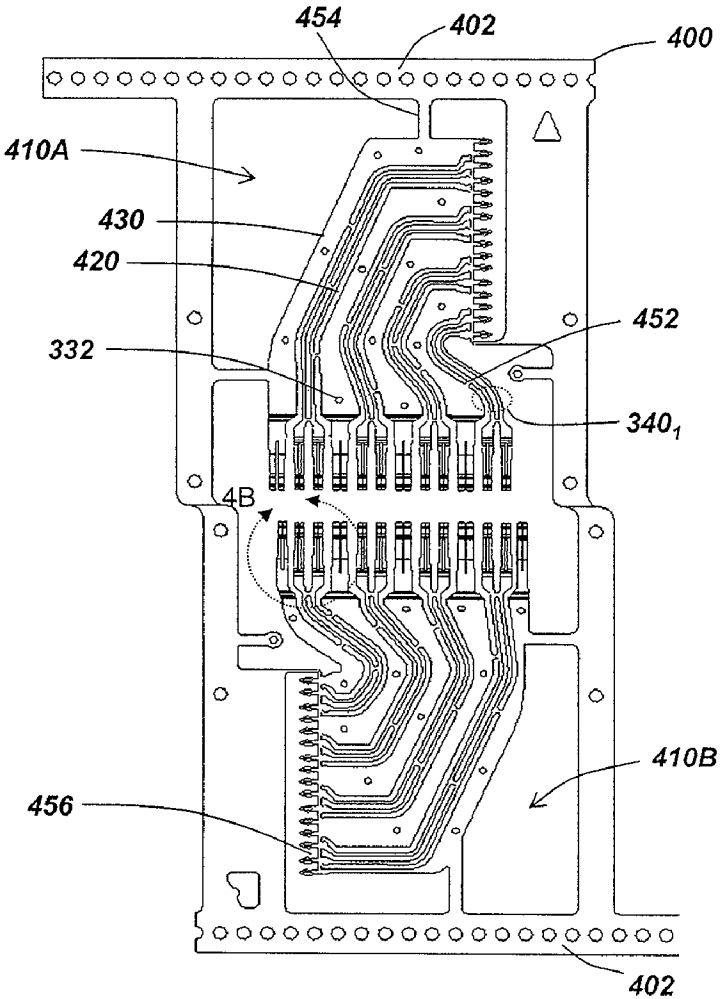
FIG. 4A is a plan view of a lead frame used in the manufacture of a connector according to an embodiment of the invention.

FIG. 4B illustrates a detailed view of the mating contact end of a differential pair $\mathbf{424}_1$ positioned between two ground mating contacts $\mathbf{434}_1$ and $\mathbf{434}_2$. As illustrated, the ground conductors may include mating contacts of different sizes. The embodiment pictured has a large mating contact $\mathbf{434}_2$ and a small mating contact $\mathbf{434}_1$. To reduce the size of each wafer, small mating contacts $\mathbf{434}_1$ may be positioned on one or both ends of the wafer.

FIG. 4B illustrates features of the mating contact portions of the conductive elements within the wafers forming daughter board connector 120. FIG. 4B illustrates a portion of the mating contacts of a wafer configured as wafer 320B. The portion shown illustrates a mating contact $\mathbf{434}_1$ such as may be used at the end of a ground conductor $\mathbf{330}_9$ (FIG. 3). Mating contacts $\mathbf{424}_1$ may form the mating contact portions of signal conductors, such as those in differential pair $\mathbf{340}_8$ (FIG. 3). Likewise, mating contact $\mathbf{434}_2$ may form the mating contact portion of a ground conductor, such as ground conductor $\mathbf{330}_8$ (FIG. 3).

In the embodiment illustrated in FIG. 4B, each of the mating contacts on a conductive element in a daughter card wafer is a dual beam contact. Mating contact $\mathbf{434}_1$ includes beams $\mathbf{460}_1$ and $\mathbf{460}_2$. Mating contacts $\mathbf{424}_1$ includes four beams, two for each of the signal conductors of the differential pair terminated by mating contact $\mathbf{424}_1$. In the illustration of FIG. 4B, beams $\mathbf{460}_3$ and $\mathbf{460}_4$ provide two beams for a contact for one signal conductor of the pair and beams $\mathbf{460}_5$ and $\mathbf{460}_6$ provide two beams for a contact for a second signal conductor of the pair. Likewise, mating contact $\mathbf{434}_2$ includes two beams $\mathbf{460}_7$ and $\mathbf{460}_8$.

Each of the beams includes a mating surface, of which mating surface 462 on beam $\mathbf{460}_1$ is numbered. To form a reliable electrical connection between a conductive element in the daughter card connector 120 and a corresponding conductive element in backplane connector 150, each of the beams $\mathbf{460}_1 \ldots \mathbf{460}_8$ may be shaped to press against a corresponding mating contact in the backplane connector 150 with sufficient mechanical force to create a reliable electrical connection. Having two beams per contact increases the likelihood that an electrical connection will be formed even if one beam is damaged, contaminated or otherwise precluded from making an effective connection.

Each of beams $\mathbf{460}_1 \ldots \mathbf{460}_8$ has a shape that generates mechanical force for making an electrical connection to a corresponding contact. In the embodiment of FIG. 4B, the signal conductors terminating at mating contact $\mathbf{424}_1$ may have relatively narrow intermediate portions $\mathbf{484}_1$ and $\mathbf{484}_2$ within the housing of wafer 320D. However, to form an effective electrical connection, the mating contact portions $\mathbf{424}_1$ for the signal conductors may be wider than the intermediate portions $\mathbf{484}_1$ and $\mathbf{484}_2$. Accordingly, FIG. 4B shows broadening portions $\mathbf{480}_1$ and $\mathbf{480}_2$ associated with each of the signal conductors.

In the illustrated embodiment, the ground conductors adjacent broadening portions $\mathbf{480}_1$ and $\mathbf{480}_2$ are shaped to conform to the adjacent edge of the signal conductors. Accordingly, mating contact $\mathbf{434}_1$ for a ground conductor has a complementary portion $\mathbf{482}_1$ with a shape that conforms to broadening portion $\mathbf{480}_1$. Likewise, mating contact $\mathbf{434}_2$ has a complementary portion $\mathbf{482}_2$ that conforms to broadening portion $\mathbf{480}_2$. By incorporating complementary portions in the ground conductors, the edge-to-edge spacing between the signal conductors and adjacent ground conductors remains relatively constant, even as the width of the signal conductors change at the mating contact region to provide desired mechanical properties to the beams. Maintaining a uniform spacing may further contribute to desirable electrical properties for an interconnection system according to an embodiment of the invention.

Some or all of the construction techniques employed within daughter card connector 120 for providing desirable characteristics may be employed in backplane connector 150. In the illustrated embodiment, backplane connector 150, like daughter card connector 120, includes features for providing desirable signal transmission properties. Signal conductors in backplane connector 150 are arranged in columns, each containing differential pairs interspersed with ground conductors. The ground conductors are wide relative to the signal conductors. Also, adjacent columns have different configurations. Some of the columns may have narrow ground conductors at the end to save space while providing a desired ground configuration around signal conductors at the ends of the columns. Additionally, ground conductors in one column may be positioned adjacent to differential pairs in an adjacent column as a way to reduce crosstalk from one column to the next. Further, lossy material may be selectively placed within the shroud of backplane connector 150 to reduce crosstalk, without providing an undesirable level attenuation for signals. Further, adjacent signals and grounds may have conforming portions so that in locations where the profile of either a signal conductor or a ground conductor changes, the signal-to-ground spacing may be maintained.

Figure 5B:
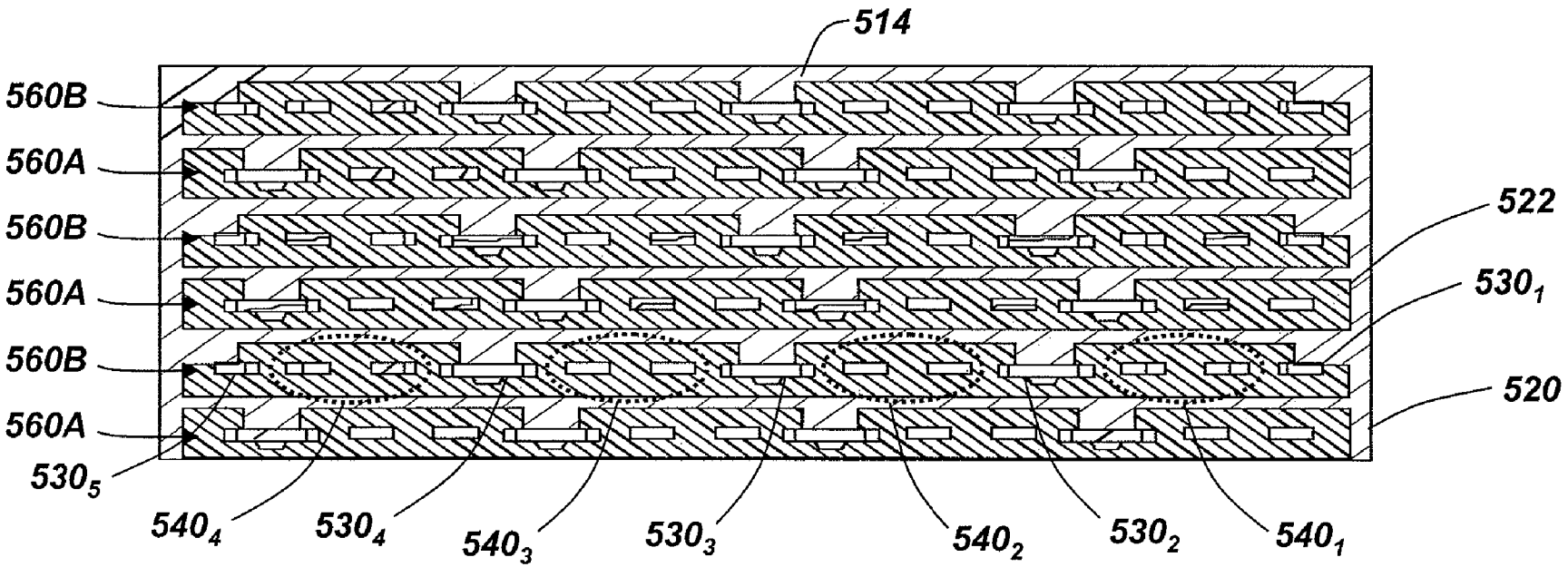
FIG. 5B is a cross-sectional representation of the backplane connector illustrated in FIG. 5A taken along the line 5B-5B.

FIGS. 5A-5B illustrate an embodiment of a backplane connector 150 in greater detail. In the illustrated embodiment, backplane connector 150 includes a shroud 510 with walls 512 and floor 514. Conductive elements are inserted into shroud 510. In the embodiment shown, each conductive element has a portion extending above floor 514. These portions form the mating contact portions of the conductive elements, collectively numbered 154. Each conductive element has a portion extending below floor 514. These portions form the contact tails and are collectively numbered 156.

The conductive elements of backplane connector 150 are positioned to align with the conductive elements in daughter card connector 120. Accordingly, FIG. 5A shows conductive elements in backplane connector 150 arranged in multiple parallel columns. In the embodiment illustrated, each of the parallel columns includes multiple differential pairs of signal conductors, of which differential pairs $\mathbf{540}_1$, $\mathbf{540}_2$ . . . $\mathbf{540}_4$ are numbered. Each column also includes multiple ground conductors. In the embodiment illustrated in FIG. 5A, ground conductors $\mathbf{530}_1$, $\mathbf{530}_2$ . . . $\mathbf{530}_5$ are numbered.

Ground conductors $\mathbf{530}_1$ . . . $\mathbf{530}_5$ and differential pairs $\mathbf{540}_1$ . . . $\mathbf{540}_4$ are positioned to form one column of conductive elements within backplane connector 150. That column has conductive elements positioned to align with a column of conductive elements as in a wafer 320B (FIG. 3). An adjacent column of conductive elements within backplane connector 150 may have conductive elements positioned to align with mating contact portions of a wafer 320A. The columns in backplane connector 150 may alternate configurations from column to column to match the alternating pattern of wafers 320A, 320B shown in FIG. 3.

Ground conductors $\mathbf{530}_2$, $\mathbf{530}_3$ and $\mathbf{530}_4$ are shown to be wide relative to the signal conductors that make up the differential pairs by $\mathbf{540}_1$ . . . $\mathbf{540}_4$. Narrower ground conductive elements, which are narrower relative to ground conductors $\mathbf{530}_2$, $\mathbf{530}_3$ and $\mathbf{530}_4$, are included at each end of the column. In the embodiment illustrated in FIG. 5A, narrower ground conductors $\mathbf{530}_1$ and $\mathbf{530}_5$ are including at the ends of the column containing differential pairs $\mathbf{540}_1$ . . . $\mathbf{540}_4$ and may, for example, mate with a ground conductor from daughter card 120 with a mating contact portion shaped as mating contact $\mathbf{434}_1$ (FIG. 4B).

FIG. 5B shows a view of backplane connector 150 taken along the line labeled B-B in FIG. 5A. In the illustration of FIG. 5B, an alternating pattern of columns of 560A-560B is visible. A column containing differential pairs $\mathbf{540}_1$ . . . $\mathbf{540}_4$ is shown as column 560B.

FIG. 5B shows that shroud 510 may contain both insulative and lossy regions. In the illustrated embodiment, each of the conductive elements of a differential pair, such as differential pairs $\mathbf{540}_1$ . . . $\mathbf{540}_4$, is held within an insulative region 522. Lossy regions 520 may be positioned between adjacent differential pairs within the same column and between adjacent differential pairs in adjacent columns. Lossy regions 520 may connect to the ground contacts such as $\mathbf{530}_1$ . . . $\mathbf{530}_5$. Sidewalls 512 may be made of either insulative or lossy material.

FIGS. 6A, 6B and 6C illustrate in greater detail conductive elements that may be used in forming backplane connector 150. FIG. 6A shows multiple wide ground contacts $\mathbf{530}_2$, $\mathbf{530}_3$ and $\mathbf{530}_4$. In the configuration shown in FIG. 6A, the ground contacts are attached to a carrier strip 620. The ground contacts may be stamped from a long sheet of metal or other conductive material, including a carrier strip 620. The individual contacts may be severed from carrier strip 620 at any suitable time during the manufacturing operation.

As can be seen, each of the ground contacts has a mating contact portion shaped as a blade. For additional stiffness, one or more stiffening structures may be formed in each contact. In the embodiment of FIG. 6A, a rib, such as 610 is formed in each of the wide ground conductors.

Each of the wide ground conductors, such as $\mathbf{530}_2$ . . . $\mathbf{530}_4$ includes two contact tails. For ground conductor $\mathbf{530}_2$ contact tails $\mathbf{656}_1$ and $\mathbf{656}_2$ are numbered. Providing two contact tails per wide ground conductor provides for a more even distribution of grounding structures throughout the entire interconnection system, including within backplane 160 because each of contact tails $\mathbf{656}_1$ and $\mathbf{656}_2$ will engage a ground via within backplane 160 that will be parallel and adjacent a via carrying a signal. FIG. 4A illustrates that two ground contact tails may also be used for each ground conductor in daughter card connector.

FIG. 6B shows a stamping containing narrower ground conductors, such as ground conductors $\mathbf{530}_1$ and $\mathbf{530}_5$. As with the wider ground conductors shown in FIG. 6A, the narrower ground conductors of FIG. 6B have a mating contact portion shaped like a blade.

As with the stamping of FIG. 6A, the stamping of FIG. 6B containing narrower grounds includes a carrier strip 630 to facilitate handling of the conductive elements. The individual ground conductors may be severed from carrier strip 630 at any suitable time, either before or after insertion into backplane connector shroud 510.

In the embodiment illustrated, each of the narrower ground conductors, such as $\mathbf{530}_1$ and $\mathbf{530}_2$, contains a single contact tail such as $\mathbf{656}_3$ on ground conductor $\mathbf{530}_1$ or contact tail $\mathbf{656}_4$ on ground conductor $\mathbf{530}_5$. Even though only one ground contact tail is included, the relationship between number of signal contacts is maintained because narrow ground conductors as shown in FIG. 6B are used at the ends of columns where they are adjacent a single signal conductor. As can be seen from the illustration in FIG. 6B, each of the contact tails for a narrower ground conductor is offset from the center line of the mating contact in the same way that contact tails $\mathbf{656}_1$ and $\mathbf{656}_2$ are displaced from the center line of wide contacts. This configuration may be used to preserve the spacing between a ground contact tail and an adjacent signal contact tail.

As can be seen in FIG. 5A, in the pictured embodiment of backplane connector 150, the narrower ground conductors, such as $\mathbf{530}_1$ and $\mathbf{530}_5$, are also shorter than the wider ground conductors such as $\mathbf{530}_2$ . . . $\mathbf{530}_4$. The narrower ground conductors shown in FIG. 6B do not include a stiffening structure, such as ribs 610 (FIG. 6A). However, embodiments of narrower ground conductors may be formed with stiffening structures.

FIG. 6C shows signal conductors that may be used to form backplane connector 150. The signal conductors in FIG. 6C, like the ground conductors of FIGS. 6A and 6B, may be stamped from a sheet of metal. In the embodiment of FIG. 6C, the signal conductors are stamped in pairs, such as pairs $\mathbf{540}_1$ and $\mathbf{540}_2$. The stamping of FIG. 6C includes a carrier strip 640 to facilitate handling of the conductive elements. The pairs, such as $\mathbf{540}_1$ and $\mathbf{540}_2$, may be severed from carrier strip 640 at any suitable point during manufacture.

As can be seen from FIGS. 5A, 6A, 6B and 6C, the signal conductors and ground conductors for backplane connector 150 may be shaped to conform to each other to maintain a consistent spacing between the signal conductors and ground conductors. For example, ground conductors have projections, such as projection 660, that position the ground conductor relative to floor 514 of shroud 510. The signal conductors have complimentary portions, such as complimentary portion 662 (FIG. 6C) so that when a signal conductor is inserted into shroud 510 next to a ground conductor, the spacing between the edges of the signal conductor and the ground conductor stays relatively uniform, even in the vicinity of projections 660.

Likewise, signal conductors have projections, such as projections 664 (FIG. 6C). Projection 664 may act as a retention feature that holds the signal conductor within the floor 514 of backplane connector shroud 510 (FIG. 5A). Ground conductors may have complimentary portions, such as complementary portion 666 (FIG. 6A). When a signal conductor is placed adjacent a ground conductor, complimentary portion 666 maintains a relatively uniform spacing between the edges of the signal conductor and the ground conductor, even in the vicinity of projection 664.

FIGS. 6A, 6B and 6C illustrate examples of projections in the edges of signal and ground conductors and corresponding complimentary portions formed in an adjacent signal or ground conductor. Other types of projections may be formed and other shapes of complementary portions may likewise be formed.

To facilitate use of signal and ground conductors with complementary portions, backplane connector 150 may be manufactured by inserting signal conductors and ground conductors into shroud 510 from opposite sides. As can be seen in FIG. 5A, projections such as 660 (FIG. 6A) of ground conductors press against the bottom surface of floor 514. Backplane connector 150 may be assembled by inserting the ground conductors into shroud 510 from the bottom until projections 660 engage the underside of floor 514. Because signal conductors in backplane connector 150 are generally complementary to the ground conductors, the signal conductors have narrow portions adjacent the lower surface of floor 514. The wider portions of the signal conductors are adjacent the top surface of floor 514. Because manufacture of a backplane connector may be simplified if the conductive elements are inserted into shroud 510 narrow end first, backplane connector 150 may be assembled by inserting signal conductors into shroud 510 from the upper surface of floor 514. The signal conductors may be inserted until projections, such as projection 664, engage the upper surface of the floor. Two-sided insertion of conductive elements into shroud 510 facilitates manufacture of connector portions with conforming signal and ground conductors.

Figure 7C:
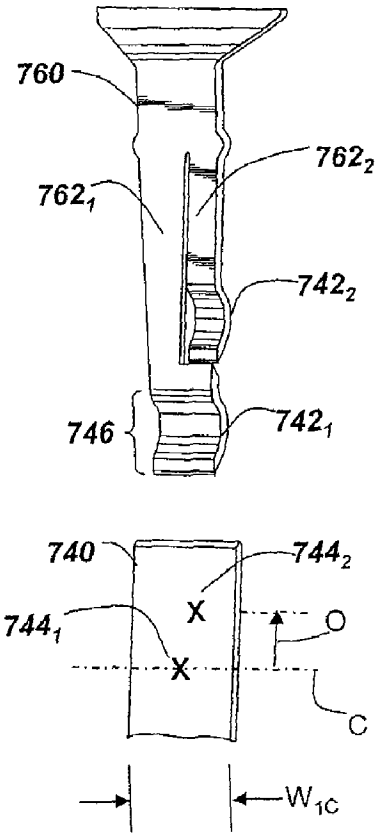
FIG. 7C is a sketch of the mating contact portions of the lead frames of two mating connectors according to a further alternative embodiment of the invention.
Figure 7B:
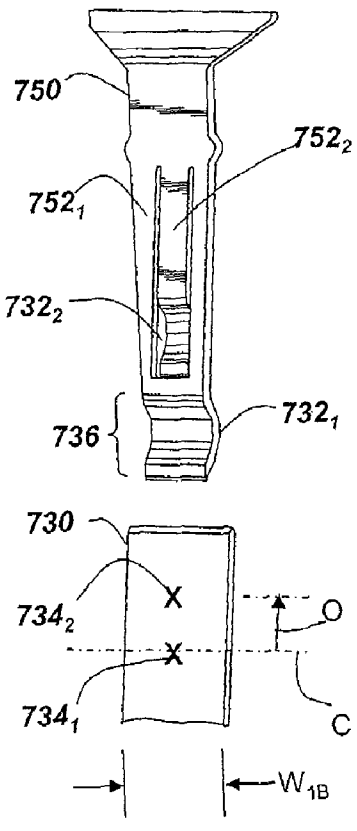
FIG. 7B is a sketch of the mating contacts of a portion of a lead frame in a connector according to an alternative embodiment of the invention.
Figure 7A:
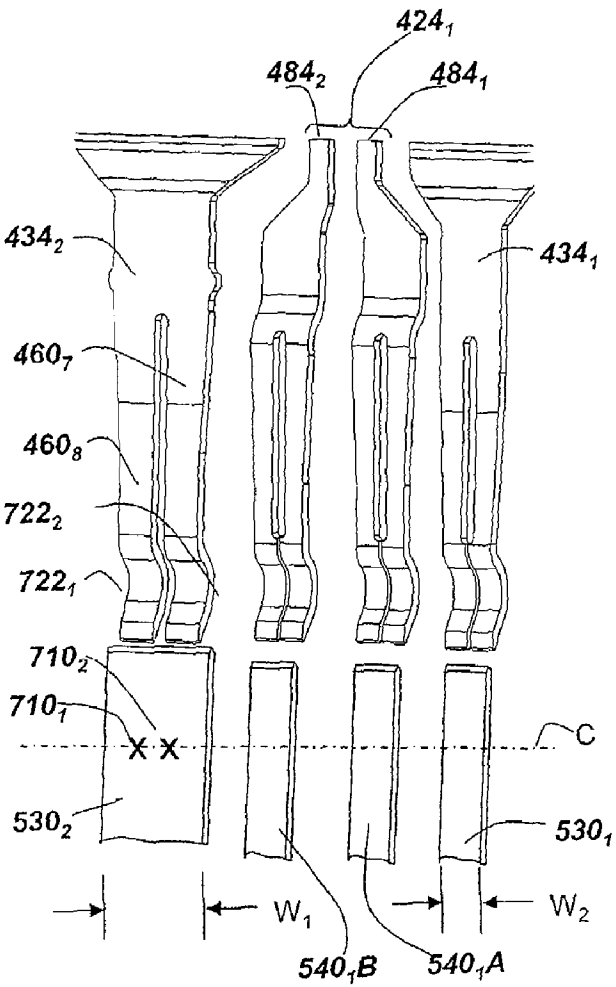
FIG. 7A is a sketch of the mating portions of lead frames in two mating connectors.

FIG. 7A is a sketch of a portion of a lead frame such as may be used in a daughter card connector according to an embodiment of the invention. FIG. 7A shows mating contacts $\mathbf{424}_1$, which may be the mating contact portions of a pair of signal conductors in a daughter card wafer. As shown, mating contacts $\mathbf{424}_1$ are aligned to fall in a column C of mating contact portions in a daughter card connector.

Also aligned with mating contacts $\mathbf{424}_1$ in column C are mating contacts $\mathbf{434}_1$ and $\mathbf{434}_2$, which may form the mating contact portions of ground conductors within the daughter card connector. The illustrated configuration positions a ground conductor in the column on both sides of mating contacts $\mathbf{424}_1$. Mating contact $\mathbf{434}_1$ is, in the embodiment illustrated, narrower than mating contact $\mathbf{434}_2$.

As described above, it is desirable in some embodiments to have ground conductors within a column to be wider than the signal conductors. However, expanding the width of the ground conductors can increase the size of the electrical connector in a dimension along the column. In some embodiments, it may be desirable to limit the dimension of the electrical connector in a dimension along the columns of signal conductors. One approach to limiting the width of the connector is, as shown in FIG. 7A, to make mating contacts at an end of a column, such as mating contact $\mathbf{434}_1$, narrower than other mating contacts in the column, such as mating contact $\mathbf{434}_2$. The narrower mating contact $\mathbf{434}_1$ may otherwise be formed with the same shape as mating contact $\mathbf{434}_2$.

An alternative approach for reducing the size of the connector in a dimension along the columns of mating contacts is to offset the points of contacts for the dual beam mating contact portions. In the embodiment of FIG. 7A, the contact points are not offset. As shown, mating contact $\mathbf{434}_2$ has two beams $\mathbf{460}_7$ and $\mathbf{460}_8$. Each of these beams has a mating surface $\mathbf{722}_1$ and $\mathbf{722}_2$, respectively. When an electrical connector containing mating surfaces $\mathbf{722}_1$and $\mathbf{722}_2$ is mated with a complementary connector, mating contact $\mathbf{434}_2$ will make contact with a mating contact in the complementary connector at mating surfaces $\mathbf{722}_1$ and $\mathbf{722}_2$. In the embodiment illustrated, the mating contact in the complementary connector is shown as ground conductor $\mathbf{530}_2$. In this embodiment, ground conductor $\mathbf{530}_2$ is shown as a blade, such as may be used in a backplane connector as described above in connection with FIG. 5. However, the shape of the mating contact is not a limitation on the invention.

As shown, mating surfaces $\mathbf{722}_1$ and $\mathbf{722}_2$ contact ground conductor $\mathbf{530}_2$ at contact points $\mathbf{710}_1$ and $\mathbf{710}_2$, respectively. For the contact configuration shown in FIG. 7A, contact points $\mathbf{710}_1$ and $\mathbf{710}_2$ are aligned in the direction of column C. To ensure that mating contact $\mathbf{434}_2$ makes reliable contact with ground conductor $\mathbf{530}_2$, ground conductor $\mathbf{530}_2$ may be constructed to have a width $W_1$ along the column. $W_1$ is larger than the width of mating contact $\mathbf{434}_2$ at the mating interface. This additional width ensures that, even with misalignment between a connector holding mating contact $\mathbf{434}_2$ and a connector holding ground conductor $\mathbf{530}_2$, both mating surfaces $\mathbf{722}_1$ and $\mathbf{722}_2$ will contact ground conductor $\mathbf{530}_2$.

In some embodiments, a mating contact having a width less than $W_1$ may be desired. FIGS. 7B and 7C illustrate alternative embodiments of a ground contact $\mathbf{434}_2$ that may be used with a mating ground conductor shaped as a blade like ground conductor $\mathbf{530}_2$ but having a width less than $W_1$. FIG. 7B shows a mating contact 750 that may be used in place of mating contact $\mathbf{434}_2$. In such an embodiment, mating contact 750 may form the mating contact portion of a wide ground conductor positioned between adjacent pairs of signal conductors in a daughter card wafer. However, the contact configuration illustrated in FIG. 7B may be used in connection with any suitable conductive element.

As with mating contact $\mathbf{434}_2$, mating contact 750 contains two beams $\mathbf{752}_1$ and $\mathbf{752}_2$, each providing a mating surface, $\mathbf{732}_1$ and $\mathbf{732}_2$, respectively. However, beams $\mathbf{752}_1$ and $\mathbf{752}_2$ are configured such that mating surface $\mathbf{732}_2$ is offset relative to mating surface $\mathbf{732}_1$ in a direction perpendicular to column C. When mating contact 750 engages ground conductor 730, mating surfaces $\mathbf{732}_1$ and $\mathbf{732}_2$ engage ground conductor 730 at contact points $\mathbf{734}_1$ and $\mathbf{734}_2$. Contact point $\mathbf{734}_2$ is offset in the direction O from contact point $\mathbf{734}_1$. As illustrated, the direction O is perpendicular to column C. Because of this offset in contact point $\mathbf{734}_1$ and $\mathbf{734}_2$, ground contact 730 may have a width $W_{1B}$ that is less than width $W_1$ of ground conductor $\mathbf{530}_2$.

In the embodiment of FIG. 7B, mating surface $\mathbf{732}_2$ is offset from mating surface $\mathbf{732}_1$ by forming beam $\mathbf{752}_2$ within beam $\mathbf{752}_1$. When a lead frame having a mating contact with a beam is incorporated into an electrical connector, the leading edge of the beam may be held within the connector housing in a way that the distal end of the beam is blocked from coming into contact with a conductive element in a mating conductor. Such a construction may avoid "stubbing" of the conductive element in the mating conductor on the beam, which can both prevent proper mating and damage the connector. With a mating contact as illustrated in FIG. 7B, the distal end of beam $\mathbf{752}_1$ may be mounted in a housing to prevent stubbing. The distal end of beam $\mathbf{752}_2$ may not be guarded by the housing. However, the configuration as shown positions the distal end of beam $\mathbf{752}_2$ behind distal portion 736 of beam $\mathbf{752}_1$, which prevents "stubbing" of ground conductor 730 on beam $\mathbf{752}_2$.

The embodiment of FIG. 7B is just one example of a configuration that may be used to form offset contact points. FIG. 7C shows an alternative embodiment. Mating contact 760 contains beams $\mathbf{762}_1$ and $\mathbf{762}_2$. The two beams provide two mating surface, $742_1$ and $742_2$. Beam $762_2$ is shorter than beam $762_1$, causing mating surface $742_2$ to be offset from contact point $742_1$. Accordingly, when mating contact 760 engages a mating contact in another connector, such as ground conductor 740, mating surfaces $742_1$ and $742_2$ engage ground conductor 740 at offset contact points $744_1$ and $744_2$. As shown, contact point $744_2$ is offset from contact point $744_2$ in direction O. As a result, ground conductor 740 may have a width $W_{1C}$ that is narrower than width $W_1$ of ground conductor $530_2$ (FIG. 7A). Furthermore, because beam $762_2$ is not fully contained within beam $762_1$ as in the configuration of FIG. 7B, the distal end of beam $762_1$ in the vicinity of mating surface $742_1$ may be narrower than the distal end of beam $752_1$ in the vicinity of mating surface $732_1$ (FIG. 7B). Accordingly, width $W_{1C}$ of ground conductor 740, in some embodiments, may be narrower than width $W_{1B}$ of ground conductor 730 (FIG. 7B). The embodiments of FIG. 7C may also be used in a manner that reduces stubbing. The distal end of beam $762_1$ may be guarded in a housing. The distal end of beam $742_2$ is guarded by portion 746, thereby preventing stubbing of ground conductor 740 on beam $742_2$.

In the embodiment illustrated in FIG. 7A, adjacent pairs of signal conductors along a column are separated by wide ground conductors that terminate in mating contacts, such as mating contact $434_2$. However, offset contact points as in the embodiments of FIGS. 7B and 7C may be used with other conductive elements. For example, some wafers, such as wafers 320B (FIG. 3) may have ground conductors at the end of a column that terminate in a narrower mating contact, such as mating contact $434_1$. These narrower grounds may have mating contacts with offset contact points. Likewise, the signal conductors in a pair may have mating contacts that also use multiple beams with offset contact points. Such an arrangement may allow narrower conductive elements for the signal conductors and/or narrow grounds in a mating connector. Accordingly, though FIGS. 7B and 7C illustrate offset points of contact only in connection with a wide ground conductor, similar approaches may be used in connection with mating contacts for conductive elements carrying signals or for narrow mating contacts for ground conductors.

Figure 8A:
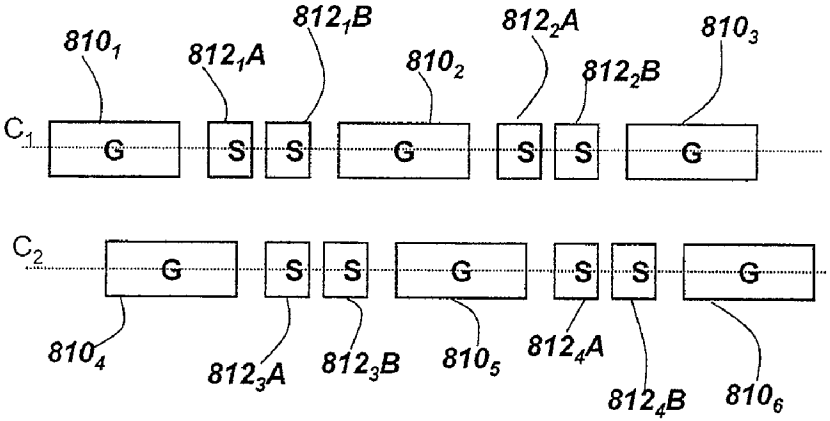
FIG. 8A is a sketch illustrating positioning of mating contact portions in a connector according to an embodiment of the invention.
Figure 8B:
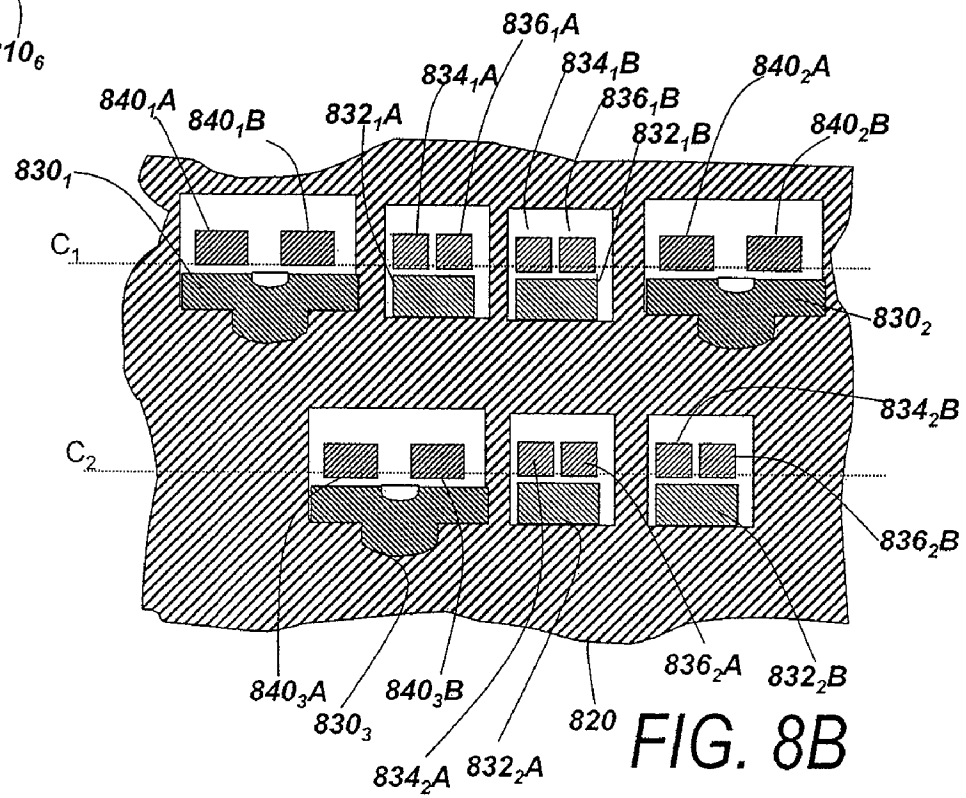
FIG. 8B is a cross-section through the mating contact portions of an electrical connector system with mating contact portions positioned as shown in FIG. 8A.

Though electrical interconnection system 100 as described above provides a high speed, high density interconnection system with desirable electrical properties, other features may be incorporated to provide even lower crosstalk or otherwise provide performance characteristics that are desirable in some embodiments. FIGS. 9A, 9B, 9C and 9D illustrate features that may be incorporated in some embodiments. For comparison, FIGS. 8A and 8B illustrate the mating interface portion of electrical interconnection system 100 (FIG. 1). As described above, both a daughter card connector 120 and backplane connector 150 contain conductive elements positioned in columns. In the embodiment illustrated, each column contains pairs of signal conductors separated by ground conductors. FIG. 8A schematically illustrates this configuration.

FIG. 8A shows only a portion of a mating interface of an electrical interconnection system. The portion shown contains two columns, $C_1$ and $C_2$. Two pairs of signal conductors are shown in each of columns $C_1$ and $C_2$. Signal conductors $812_1$A and $812_1$B form one pair in column $C_1$. A second pair in column $C_1$ is formed by signal conductors $812_2$A and $812_2$B. The portion of column $C_2$ illustrated also contains two pairs of signal conductors, formed by signal conductors $812_3$A and $812_3$B, with a second pair formed by signal conductors $812_4$A and $812_4$B. Each column contains ground conductors adjacent the pairs of signal conductors. Accordingly, column $C_1$ contains ground conductors $810_1$, $810_2$ and $810_3$. Likewise, column $C_2$ contains ground conductors $810_4$, $810_5$ and $810_6$.

The portions shown in FIG. 8A contain two pairs of signal conductors with adjacent ground conductors. However, in many embodiments a connector will have more than two pairs per column. The alternating pattern of signal pairs and ground conductors may be extended to provide any number of pairs of signal conductors within each column. The repeating pattern may end with a signal conductor at the end of the column. Though in other embodiments, a column may end with a ground conductor of the same width as other ground conductors in the column or with a narrower ground conductor.

FIG. 8B illustrates in cross section the configuration of conductive elements in mating connectors that form the pattern shown in FIG. 8A. In the embodiment shown, the conductive elements forming the mating interface are contained within housing 820. Housing 820 may be formed by a front housing 130 (FIG. 1) or other suitable component. For simplicity, FIG. 8B shows an even smaller portion of the two columns than is illustrated in FIG. 8A, showing only one pair of signal conductors in each column. For example, the portion shown may correspond to ground conductors $810_1$, $810_2$ and $810_4$, with signal conductors $812_1$A, $812_1$B, $812_3$A and $812_3$B. However, as observed above in connection with FIG. 8A, the alternating pattern of signal pairs and ground conductors may be repeated to provide any suitable number of pairs of signal conductors in each column.

In electrical interconnection system 100 (FIG. 1), blade-shaped mating contacts from backplane connector 150 enter front housing portion 130 of daughter card connector 120 where they mate with beam-shaped contacts at the ends of conductive elements within daughter card connector 120. Thus, the mating interface between daughter card connector 120 and backplane connector 150 is formed by beams pressing against blades.

FIG. 8A shows both blades and beams for both signal and ground conductors positioned so that the conductive elements at the mating interface are aligned in columns. The configuration illustrated in FIG. 8A may be achieved by positioning the blades of the signal conductors and ground conductors in parallel columns and positioning beam-shaped contacts to mate on the same sides of the blades. As illustrated in FIG. 8B, ground blades $830_1$, signal blades $832_1$A and $832_1$B and ground blade $830_2$ are positioned in parallel in column $C_1$ Similarly, ground blade $830_3$ is positioned in parallel with signal blades $832_2$A and $832_2$B in column $C_2$. As a result, when the ground blades in a first conductor mate with beams in a second conductor, the conductive elements mate in a plane containing mating surface of the ground blades. This configuration is illustrated in FIG. 8B, which shows the beams $840_1$A and $840_1$B of a ground conductor engaging blade $830_1$. Beams $834_1$A and $836_1$A likewise engage a signal blade $832_1$A and beams $834_1$B and $836_1$B likewise engage a blade $832_1$B. Continuing along column $C_1$, beams $840_2$A and $840_2$B of a ground conductor engage blade $830_2$.

The same pattern appears in column $C_2$. Blades $830_3$, $832_2$A and $832_2$B are positioned in parallel along column $C_2$. Beams $840_3$A, $840_3$B, $834_2$A, $836_2$A, $834_2$B and $836_2$B engage these blades in a plane along the column.

Figure 9A:
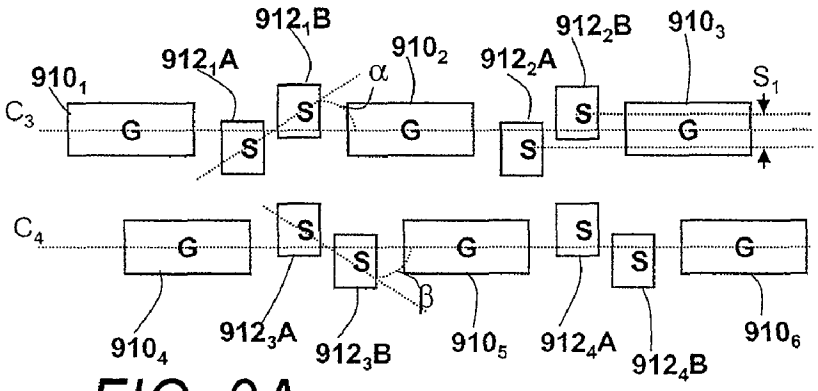
FIG. 9A is a sketch illustrating positioning of mating contact portions of an electrical connector according to an embodiment of the invention.

FIG. 9A illustrates an alternative configuration that may reduce crosstalk between pairs of signal conductors in adjacent columns, particularly crosstalk that may be generated at the mating interface. FIG. 9A illustrates portions of two columns of conductive elements within a connector according to an alternative embodiment of the invention. FIG. 9A shows portions of columns $C_3$ and $C_4$. As with columns $C_1$ and $C_2$ illustrated in FIG. 8A, portions of each of columns $C_3$ and $C_4$ containing two pairs of signal conductors are shown. In column $C_3$, signal conductors 912$_1$A and 912$_1$B form one pair of signal conductors. Signal conductors 912$_2$A and 912$_2$B form a second pair. In column $C_4$, signal conductors 912$_3$A and 912$_3$B form one pair and signal conductors 912$_4$A and 912$_4$B form a second pair. A ground conductor is positioned adjacent each pair of signal conductors. Accordingly, column $C_3$ contains ground conductors 910$_1$, 910$_2$ and 910$_3$. Column $C_4$ contains ground conductors 910$_4$, 910$_5$ and 910$_6$.

The configuration of FIG. 9A differs from the configuration of FIG. 8A in that the signal conductors within each pair are rotated relative to the column. In the embodiment illustrated, the rotation of each pair is achieved by separating the center lines of the signal conductors forming the pair by a distance $S_1$ in a direction perpendicular to the column. Accordingly, FIG. 9A shows that signal conductor 912$_1$A is centered below the center line of column $C_3$. Signal conductor 912$_1$B is centered above the center line of column $C_3$, with a resulting separation of $S_1$ between the centers of signal conductors 912$_1$A and 912$_1$B. With this separation, a line through the signal conductors 912$_1$A and 912$_1$B is skewed by an angle a relative to column $C_3$.

In the embodiment illustrated, each of the pairs of signal conductors within column $C_3$ may be similarly rotated by the angle a. Accordingly, signal conductor 912$_2$A is offset from the center line of column $C_3$ by the same amount as signal conductor 912$_1$A. Signal conductor 912$_2$B is offset from the center line of column $C_3$ by the same amount as signal conductor 912$_1$B. Though it is not necessary that all pairs in a column be rotated the same amount.

The pairs of signal conductors in other columns may be rotated similarly by an angle $\alpha$. However, pairs in each column may be rotated by different amounts. For example, in the embodiment of FIG. 9A, the signal conductors that make up pairs in column $C_4$ are rotated by an angle $\beta$. The angles $\alpha$ and $\beta$ may have any suitable magnitude and direction. In the embodiment illustrated, the angles $\alpha$ and $\beta$ have magnitudes that are approximately equal but are of opposite direction.

Figure 9B:
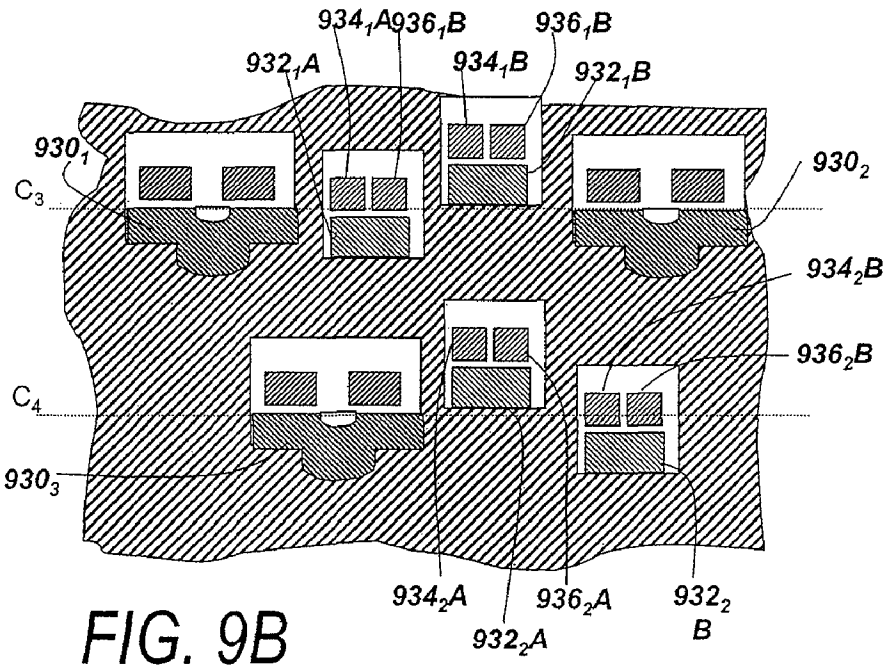
FIGS. 9B, 9C and 9D are cross-sections through the mating contact portions in alternative embodiments of an electrical connector having mating contact portions positioned as illustrated in FIG. 9A.

FIG. 9B illustrates a manner in which the offsets illustrated in FIG. 9A may be achieved. FIG. 9B, like FIG. 8B, illustrates a cross section through the mating interface of a connector. In the embodiment of FIG. 9B, rotation is achieved by positioning signal conductor blades offset from the center line of each column. Accordingly, FIG. 9B shows ground blades 930$_1$A and 930$_2$ positioned along a line defining column $C_3$. In contrast, signal blade 932$_1$A is offset from the center line of column $C_3$. Signal blade 932$_1$B is offset on the other side of the center line of column $C_3$. In column $C_4$, ground blade 930$_3$ is positioned along the center line of the column. Signal blade 932$_2$A is offset in one direction relative to the center line and signal blade 932$_2$B is offset in an opposite direction. In a connector system such as system 100 (FIG. 1), such offsets may be formed by positioning blades in a backplane connector in columns with offsets as illustrated. However, any suitable mechanism may be used to form the offsets.

To achieve mating, the signal beams may be offset by a corresponding amount. Accordingly, signal beams 934$_1$A and 936$_1$A are shown with an offset that matches that of signal blade 932$_1$A. Signal beams 934$_1$B and 936$_1$B are similarly shown with an offset that matches that of signal blade 932$_1$B. Signal beams 934$_2$A and 936$_2$A have an offset matching that of signal blade 932$_2$A and signal beams 934$_2$B and 936$_2$B have an offset matching that of 932$_2$B. In a connector system such as system 100 (FIG. 1), such offsets may be obtained by forming lead frames, such as lead frame 400 (FIG. 4A) used to construct a daughter card, in a forming die to create the desired relative position of conductive elements prior to incorporating the conductive elements in a housing. However, other mechanisms are possible, such as using two lead frames, each holding one signal conductor of a pair. Accordingly, any suitable mechanism may be used to create the offsets.

Figure 9C:
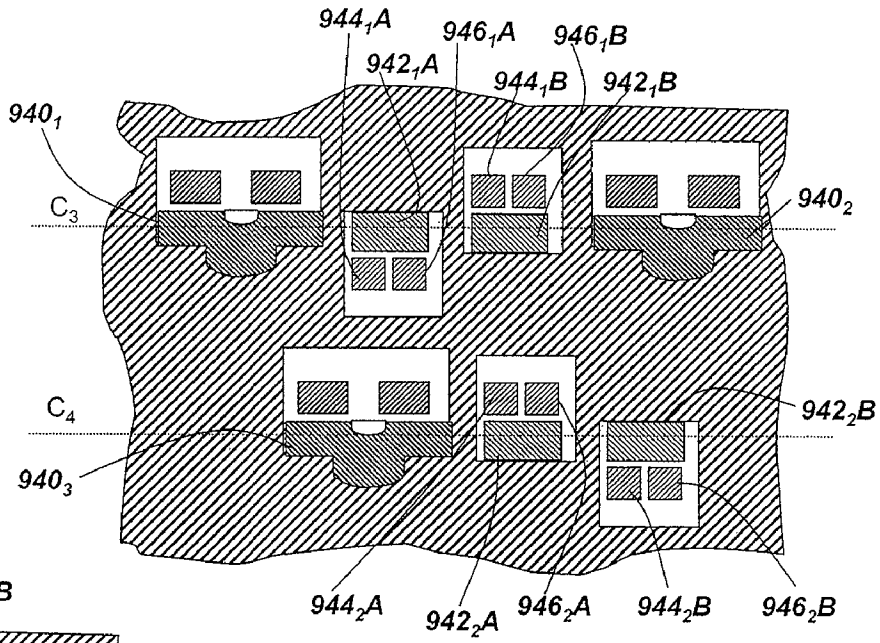

FIG. 9C illustrates an alternative construction technique that may be used to provide rotation as illustrated in FIG. 9A. In the embodiment of FIG. 9C, each of the blades of a column is centered along the center line of the column. However, rotation is achieved by positioning the signal beams of a pair to contact the signal blades on opposite sides. For example, in column $C_3$, ground blades 940$_1$ and 940$_2$ are centered along the center line of column $C_3$. Likewise, signal blades 942$_1$A and 942$_1$B are centered along the center line of the column. However, offset is achieved by positioning signal beams 944$_1$A and 946$_1$A to mate with a surface of signal blade 942$_1$A that is on one side of the center line of column $C_3$. Signal beams 944$_1$B and 946$_1$B are positioned to mate on a surface of signal blade 942$_1$B that is on the opposite side of the center line of column $C_3$.

A similar configuration is used in column $C_4$ to offset of the conductive elements of a pair in a direction perpendicular to a column. As shown, ground blade 940$_3$ and signal blades 942$_2$A and 942$_2$B are centered along the center line of column $C_4$. However, rotation of the signal pairs is achieved by positioning signal beams 944$_2$A and 946$_2$A to contact signal blade 942$_2$A on one side of the center line of column $C_4$ while signal beams 944$_2$B and 946$_2$B are positioned to contact signal blade 942$_2$B on an opposite side of the center line.

Figure 9D:
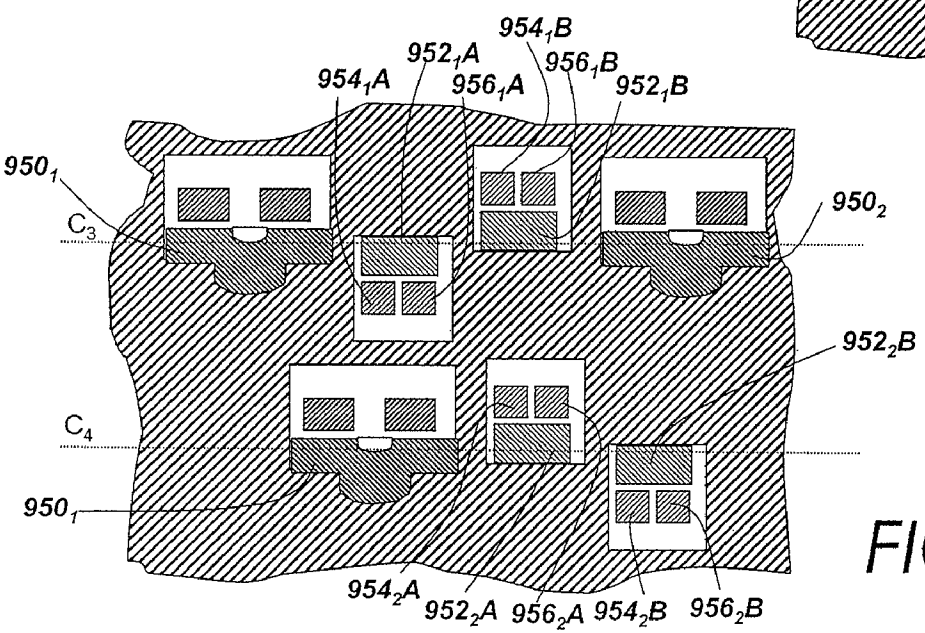

Yet a further embodiment is shown in FIG. 9D, which illustrates that rotation may be introduced by both offsetting the position of the signal conductors relative to the center line of the column and alternating the sides of the signal blades where the signal beams contact. Accordingly, FIG. 9D shows that ground blades 950$_1$ and 950$_2$ are positioned along the center line of column $C_3$. Signal blade 952$_1$A is offset relative to the center line in one direction and signal blade 952$_2$B is offset in an opposite direction. Likewise, in column $C_4$, ground blade 950$_3$ is positioned along the center line of the column but signal blade 952$_2$B is offset in one direction relative to the center line and signal blade 952$_2$A is offset in the opposite direction. To provide greater rotation, signal beams 954$_1$A and 956$_1$A contact signal blade 952$_1$A on one side while signal beams 954$_1$B and 956$_1$B contact signal blade 952$_2$B on an opposite side. Similarly, signal beams 954$_2$B and 956$_2$B contact signal blade 952$_2$B on one side and signal beams 954$_2$A and 956$_2$A contact signal blade 952$_2$A on the opposite side.

Figure 10A:
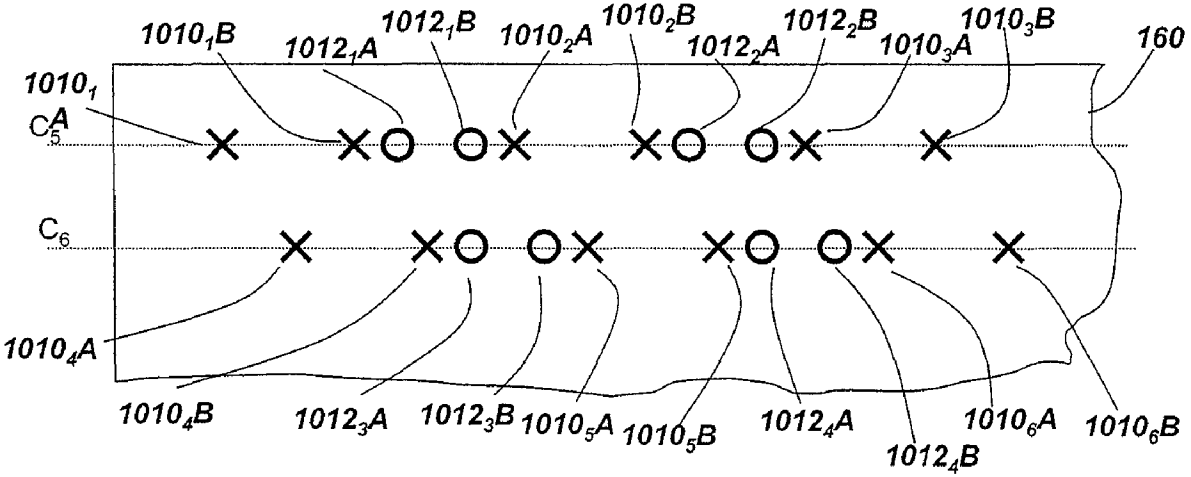
FIG. 10A is a sketch illustrating a connector footprint according to an embodiment of the invention.

Rotating the conductors within a pair relative to a column is believed to reduce the pair-to-pair crosstalk between pairs in adjacent columns. FIGS. 9A, 9B, 9C and 9D illustrate how rotation can be introduced into the mating contact portion of an electrical interconnection system. Rotation can similarly be introduced in the electrically conductive elements that form signal pairs in other portions of the interconnection system. For example, FIG. 10A shows a portion of a connector footprint in backplane 160 (FIG. 1). For a connector such as is illustrated in FIG. 1 in which conductive elements have press fit contact tails, a connector footprint may be formed with vias in backplane 160. However, depending on the form of contact tail, a connector footprint may be formed with other conductive elements, such as pads, in a printed circuit board.

FIG. 10A shows a portion of a connector footprint containing columns $C_5$ and $C_6$ of vias. A connector footprint may be formed with any suitable number of columns and two are shown for simplicity. The portion of the connector footprint illustrated by FIG. 10A provides vias for attaching two pairs of conductive elements for two differential signals in each column with ground conductors adjacent each pair. However, each column may have any suitable number of signal conductors and ground conductors.

Vias $\mathbf{1010}_1$A and $\mathbf{1010}_1$B are positioned to receive contact tails from a ground conductor, such as contact tails $\mathbf{656}_1$ and $\mathbf{656}_2$ from ground conductor $\mathbf{530}_2$ (FIG. 6A). Vias $\mathbf{1010}_2$A and $\mathbf{1010}_2$B are similarly positioned to receive contact tails from a second ground conductor. Vias $\mathbf{1010}_3$A and $\mathbf{1010}_3$B are positioned to receive contact tails from yet a third ground conductor. In column $C_6$, vias $\mathbf{1010}_4$A and $\mathbf{1010}_4$B are positioned to receive contact tails from a fourth ground conductor. Vias $\mathbf{1010}_5$A and $\mathbf{1010}_5$B are positioned to receive contact tails from a fifth ground conductor and vias $\mathbf{1010}_6$A and $\mathbf{1010}_6$B are likewise positioned to receive contact tails from a sixth ground conductor.

Vias $\mathbf{1012}_1$A and $\mathbf{1012}_1$B are positioned to receive contact tails, such as contact tails $\mathbf{656}_6$ and $\mathbf{656}_7$ associated with a pair $\mathbf{540}_2$ of signal conductors (FIG. 6C). Vias $\mathbf{1012}_2$A and $\mathbf{1012}_2$B are similarly positioned to receive contact tails from a second pair of signal conductors. Within column $C_6$, vias $\mathbf{1012}_3$A and $\mathbf{1012}_3$B are positioned to receive contact tails from a third pair of signal conductors and vias $\mathbf{1012}_4$A and $\mathbf{1012}_4$B are positioned to receive contact tails from a fourth pair of signal conductors. In the embodiment of FIG. 10A, all of the vias in column $C_5$ are positioned along the center line of the column. Similarly, the vias in column $C_6$ are also positioned along the center line.

Figure 10B:
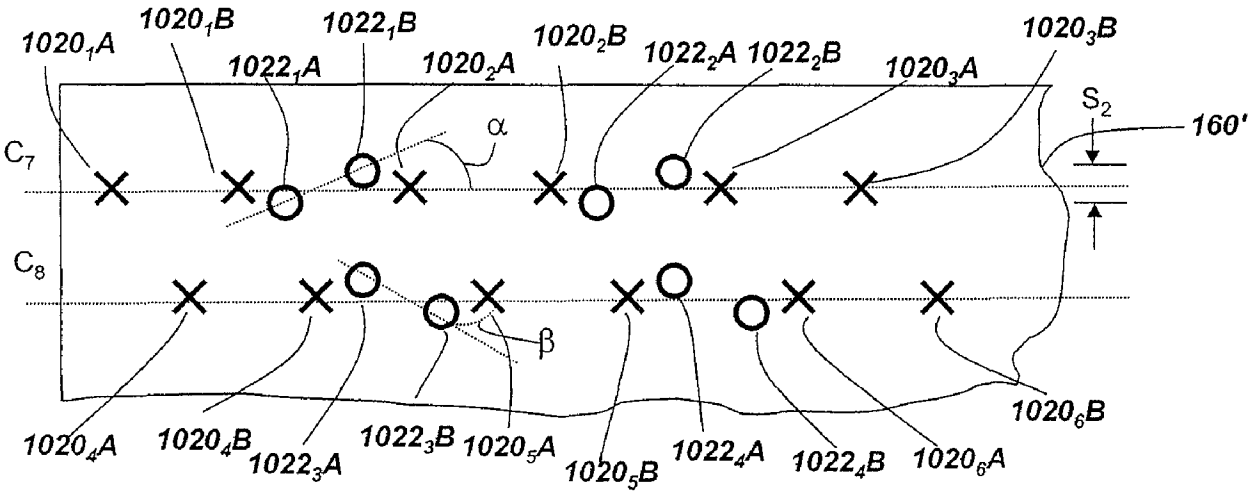
FIG. 10B is a sketch of a connector footprint according to an embodiment of the invention.

FIG. 10B shows an alternative embodiment of a connector footprint formed in backplane 160'. The configuration of vias in FIG. 10B differs from that in FIG. 10A in that the vias associated with each pair of signal conductors are rotated. As with the connector footprint in FIG. 10A, vias are disposed in columns, of which columns $C_7$ and $C_8$ are shown. Column $C_7$ contains vias for receiving contact tails from two pairs of signal conductors and adjacent ground conductors. Vias $\mathbf{1022}_1$A and $\mathbf{1022}_1$B receive contact tails from a first pair of signal conductors. Vias $\mathbf{1022}_2$A and $\mathbf{1022}_2$B are positioned to receive contact tails from a second pair of signal conductors. Vias $\mathbf{1020}_1$A and $\mathbf{1020}_1$B are positioned to receive contact tails from a ground conductor. Vias $\mathbf{1020}_2$A and $\mathbf{1020}_2$B are positioned to receive contact tails from a second ground conductor. Vias $\mathbf{1020}_3$A and $\mathbf{1020}_3$B are positioned to receive contact tails from a third ground conductor. In column $C_7$, via $\mathbf{1022}_1$B is offset from the center line of column $C_7$ in a first direction and via $\mathbf{1022}_1$A is offset from the center line in the opposite direction. As a result, the vias $\mathbf{1022}_1$A and $\mathbf{1022}_1$B are separated by a distance $S_2$ creating rotation at an angle a. Vias $\mathbf{1022}_2$A and $\mathbf{1022}_2$B are similarly offset from the center line of column $C_7$.

Within column $C_8$, vias $\mathbf{1022}_3$A and $\mathbf{1022}_3$B are positioned to receive contact tails from a third pair of signal conductors. Vias $\mathbf{1022}_4$A and $\mathbf{1022}_4$B are positioned to receive contact tails from a fourth pair of signal conductors. Vias $\mathbf{1020}_4$A and $\mathbf{1020}_4$B are positioned to receive contact tails from a fourth ground conductor. Likewise, vias $\mathbf{1020}_5$A and $\mathbf{1020}_5$B are positioned to receive contact tails from a fifth ground conductor and vias $\mathbf{1020}_6$A and $\mathbf{1020}_6$B are positioned to receive contact tails from a sixth ground conductor. As with the vias for receiving contact tails from signal conductors in column $C_7$, vias $\mathbf{1022}_3$A and $\mathbf{1022}_3$B are rotated at an angle $\beta$, as illustrated. Vias $\mathbf{1022}_4$A and $\mathbf{1022}_4$B are similarly rotated.

In the embodiment illustrated, all of the pairs of signal conductors within each column are offset by approximately the same amount. Though, pairs of signal conductors in adjacent columns are rotated in opposite directions. Accordingly, in FIG. 10B, angle $\alpha$ and angle $\beta$ are shown to be of approximately equal magnitude but in opposite directions. However, neither the amount nor direction of the rotation is a limitation of the invention. Different signal conductors within the same column may be rotated by the same or different amounts. Likewise, the rotation angles in all columns may be the same or different.

Figures 11A, 11B, 11C, 11D:
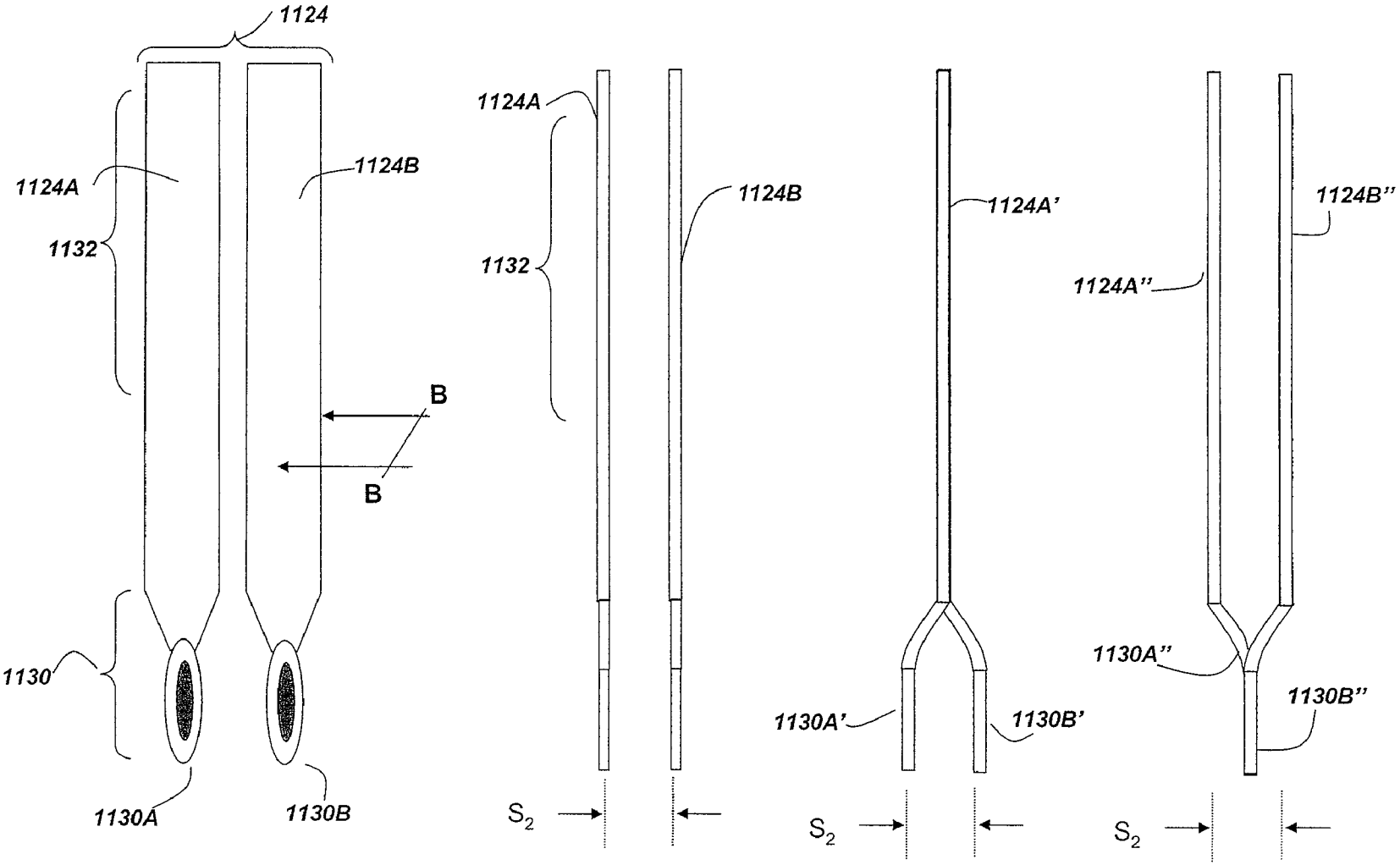
FIG. 11A is a schematic representation of a pair of conductive elements for an electrical connector according to an embodiment of the invention.
FIGS. 11B, 11C and 11D are side views of the pair of conductive elements of FIG. 11A according to alternative embodiments of the invention.

Turning to FIGS. 11A, 11B and 11C, embodiments of signal conductors that may be used with the footprint of FIG. 10B and the mating interfaces depicted in FIGS. 9B, 9C and 9D are illustrated. FIG. 11A shows a pair 1124 of signal conductors, containing signal conductors 1124A and 1124B. The pair has a contact tail portion 1130, containing contact tails 1130A and 1130B, respectively.

FIG. 11A shows the mating contact surfaces of the signal conductors 1124A and 1124B. The signal conductors are here shaped as blades, such as may be used in a backplane connector, like backplane connector 120 (See FIG. 1). However, the specific configuration of the signal conductors is not a limitation on the invention and rotation may be introduced into pairs of conductive elements shaped as beams or in any other configuration.

FIG. 11B shows a side view of pair 1124, taken from the perspective of line B-B (FIG. 11A). In the embodiment of FIG. 11B, both signal conductors 1124A and 1124B are generally planar and parallel along their length. The signal conductors are spaced by a distance S2. Though FIG. 11B does not show structural members of a connector holding signal conductors 1124A and 1124B in the position illustrated, a connector may be formed with a housing or other support structure fixing the signal conductors 1124A and 1124B as shown so that the center line of the column in which signal conductors 1124A and 1124B are mounted passes between the signal conductors. Accordingly, a connector containing signal conductors positioned as shown in FIG. 11B may be used with a footprint as shown in FIG. 10B in which signal conductors in a pair are offset by an amount $S_2$.

In the embodiment of FIG. 11B, because the signal conductors 1124A and 1124B are generally parallel and planar, mating contact portions 1132 are likewise separated by a distance $S_2$. Accordingly, signal conductors configured as shown in FIG. 11B are also suitable for use in connector configurations as illustrated in FIGS. 9B and 9D in which the mating contact portions of the signal conductors are also offset from a counterline of a column.

An alternative embodiment is illustrated in FIG. 11C. In the embodiment of FIG. 11C, the contact tails 1130A' and 1130B' are offset by a distance $S_2$. Like the embodiment illustrated in FIG. 11B, the signal conductors as illustrated in FIG. 11C may be fixed in a housing and used with a connector footprint such as is illustrated in FIG. 10B. However, the embodiment of FIG. 11C differs from the embodiment of FIG. 11B in that the mating contact portions 1132 are aligned. Accordingly, signal conductors in the configuration shown in FIG. 11C may be used in embodiments such as are illustrated in FIGS. 8B and 9C in which the mating contact portions of the signal conductors are aligned with the center line of a column.

FIG. 11D shows yet a further embodiment for the construction of a pair of signal conductors. In the embodiment of FIG. 11D, the contact tails 1130A" and 1130B" of the signal conductors are aligned. Accordingly, signal conductors configured as illustrated in FIG. 11D are useful for a connector footprint as illustrated in FIG. 10A. However, the mating contact portions of signal conductors 1124A and 1124B are, in the embodiment illustrated in FIG. 11D, offset by a distance S2 Accordingly, signal conductors formed as shown in FIG. 11D may be used in embodiments such as are illustrated in FIGS. 9B and 9D.

The alternatives illustrated in FIGS. 11A, 11B, 11C and 11D demonstrate that different portions of the conductive elements forming signal pairs within an electrical interconnection system may be offset by different amounts in different portions of the electrical interconnection system. Rotation of the signal pairs may be provided at the mating interface and/or at the connector footprint where contact tails of the signal conductors connect to conductive elements within a printed circuit board. Similarly, conductive elements forming a pair within a wafer or other portion of an electrical connector may likewise be rotated.

Figure 12A:
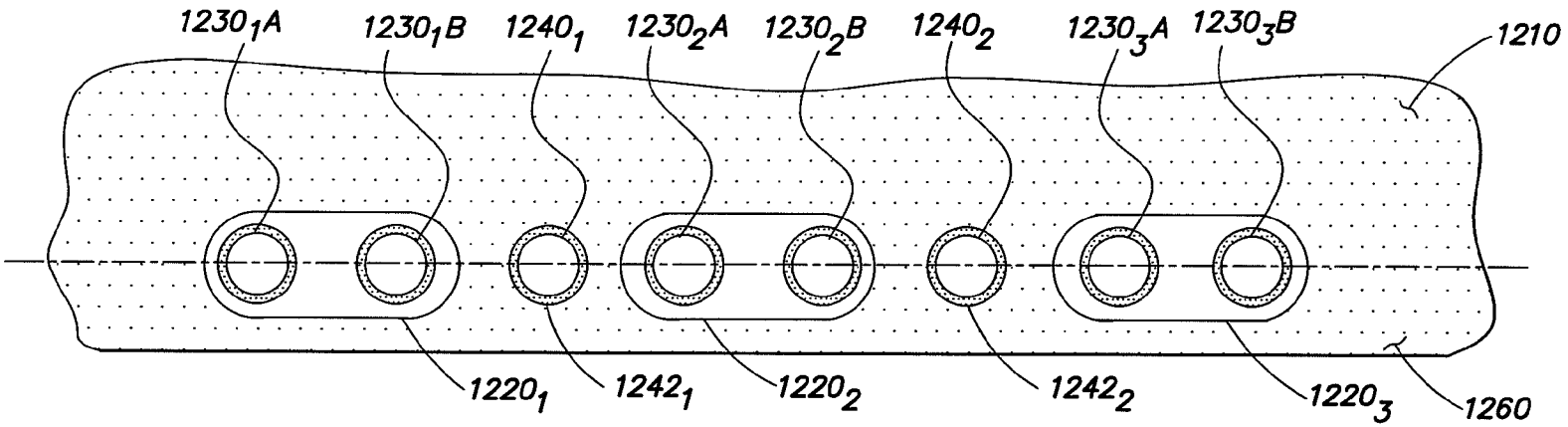
FIG. 12A (Prior Art)
FIG. 12A is a sketch of antipads in a connector footprint according to the prior art.
Figure 12B:
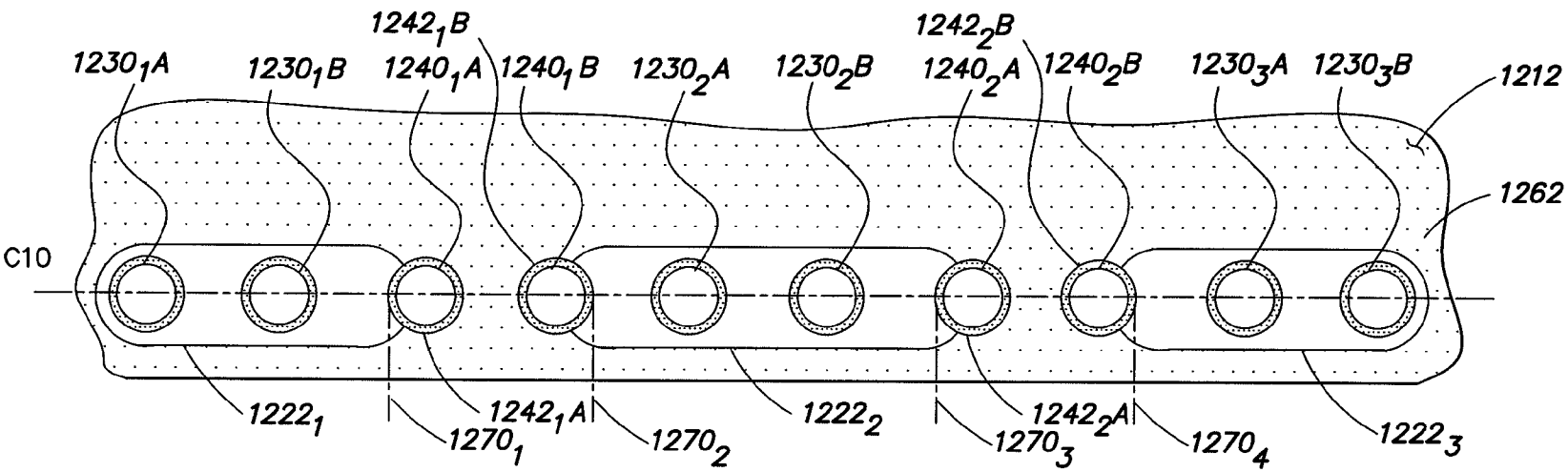
FIGS. 12B and 12C are sketches of alternative embodiments of antipads in footprints for connectors according to embodiments of the invention.
Figure 12C:
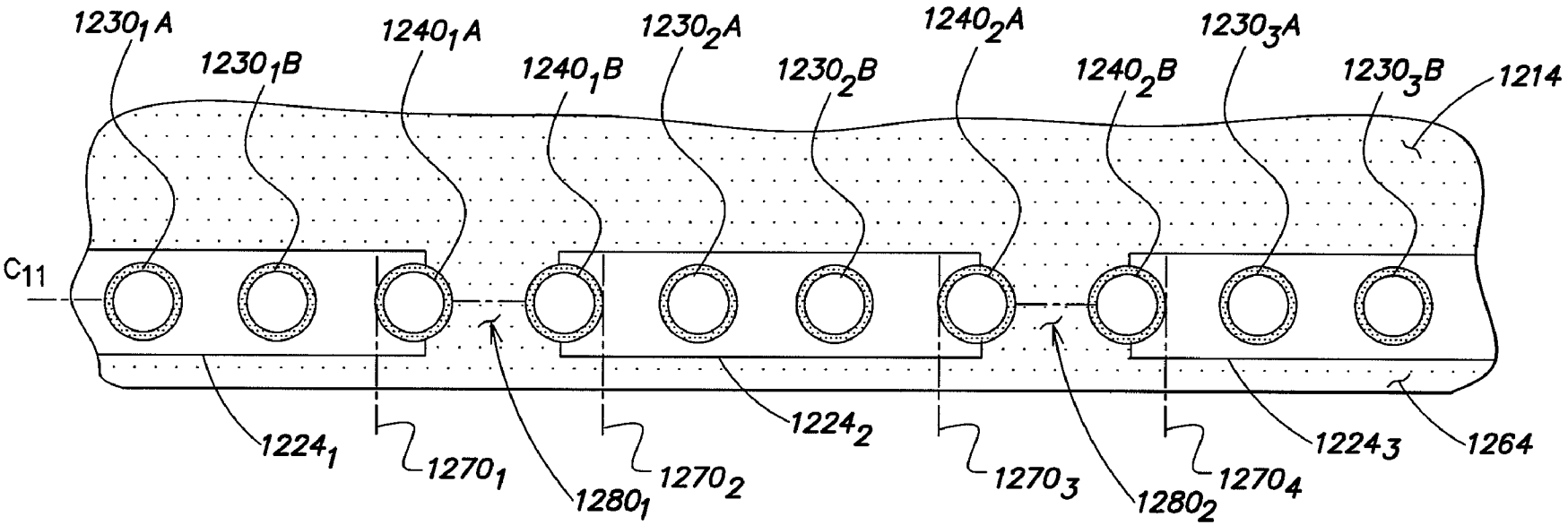

Turning to FIGS. 12A and 12B, a further technique for altering the electrical properties of an interconnection system is illustrated. The inventors have appreciated that altering the configuration of apertures in a ground plane around pairs of signal conductors may improve both the insertion loss and the linearity of the insertion loss associated with a pair of signal conductors. FIGS. 12B and 12C illustrate improved printed circuit board configurations according to embodiments of the invention. In contrast, FIG. 12A illustrates a board configuration as is known in the art.

FIG. 12A illustrates a portion of a printed circuit board 1260. As is known in the art, a printed circuit board may be constructed with multiple layers of conductive elements separated by insulative members. Frequently, layers containing signal traces alternate with layers supplying reference potentials, sometimes called "ground planes." FIG. 12A illustrates a ground plane 1210. The layer as shown may appear at any level of the printed circuit board 1260, including at a surface or embedded within the board. Further, a printed circuit board may contain multiple ground planes. Thus, the structure shown in FIG. 12A may be repeated at one or more layers of a printed circuit board.

Frequently, vias carrying a ground potential are electrically coupled to the ground plane 1210. A connection may be formed by forming ground vias, such as $\mathbf{1240}_1$, $\mathbf{1240}_2$ or $\mathbf{1240}_3$ through the ground plane and plating the walls of the via with metal or other conductor. That electrical coupling is facilitated by ensuring that, regardless of any patterning of ground plane $\mathbf{120}_1$, a region of ground plane 1210 remains as a "pad" $\mathbf{1242}_1$ around each via. A similar technique is also used around signal vias. Even though ground plane 1210 may be patterned, a portion of the conductive layer used to form ground plane 1210 is left as a pad, such as pad $\mathbf{1242}_2$, in the vicinity of each signal via.

The pads around the signal vias are separated from the rest of ground plane 1210. Openings may be patterned in ground plane 1210 where vias carrying signals pass through the layer. Without the openings, the signals in the vias could be shorted to the ground plane 1210. Openings in the ground plane to avoid making electrical contact to ground plan 120 are sometimes call "antipads."

In FIG. 12A, vias $\mathbf{1230}_1$A and $\mathbf{1230}_1$B are shown positioned to carry a differential signal. Likewise, vias $\mathbf{1230}_2$A and $\mathbf{1230}_2$B are positioned to carry a second differential signal. Vias $\mathbf{1230}_3$A and $\mathbf{1230}_3$B are positioned to carry a third differential signal. Antipad $\mathbf{1220}_1$ is formed around vias $\mathbf{1230}_1$A and $\mathbf{1230}_1$B to prevent the vias from being shorted to ground plane 1210. Likewise, antipad $\mathbf{1220}_2$ is formed around vias $\mathbf{1230}_2$A and $\mathbf{1230}_2$B and antipad $\mathbf{1220}_3$ s vias $\mathbf{1230}_3$A and $\mathbf{1230}_3$B.

As described in U.S. Pat. No. 6,607,402, which is hereby incorporated by reference, forming antipads around pairs of signal conductors may impart desirable electrical characteristics to the pair.

The inventors have appreciated that by extending the antipads closer to ground vias than is illustrated in FIG. 12A, the electrical characteristics of signal pairs enclosed within the antipads may be improved. FIG. 12B shows an embodiment of a printed circuit board 1262 in which antipads $\mathbf{1222}_1$, $\mathbf{1222}_2$ and $\mathbf{1222}_3$ are extended towards adjacent ground vias. In the embodiment illustrated in FIG. 12B, ground plane 1212, forming one layer of printed circuit board 1262, is coupled to ground vias $\mathbf{1240}_1$A, $\mathbf{1240}_1$B, $\mathbf{1240}_2$A and $\mathbf{1240}_2$B. In the embodiment illustrated, ground vias $\mathbf{1240}_1$A and $\mathbf{1240}_1$B are, like ground vias $\mathbf{1010}_1$A and $\mathbf{1010}_1$B (FIG. 10A) positioned to receive contact tails from a ground conductor. Likewise ground vias $\mathbf{1240}_2$A and $\mathbf{1240}_2$B are positioned to receive contact tails from a second similar ground conductor.

In the embodiment of FIG. 12B, the vias associated with each pair of signal conductors are likewise enclosed within an antipad. As shown, pair of vias $\mathbf{1230}_1$A and $\mathbf{1230}_1$B is enclosed within antipad $\mathbf{1222}_1$. A pair of vias $\mathbf{1230}_2$A and $\mathbf{1230}_2$B is enclosed within antipad $\mathbf{1222}_2$ and a pair of vias $\mathbf{1230}_3$A and $\mathbf{1230}_3$B is enclosed within antipad $\mathbf{1222}_3$. In comparison to the antipads, such as $\mathbf{1220}_1$, $\mathbf{1220}_2$ and $\mathbf{1220}_3$ shown in FIG. 12A, antipads $\mathbf{1222}_1$, $\mathbf{1222}_2$ and $\mathbf{1222}_3$ are elongated along the dimension of column $C_{10}$. As a result of the elongation, each of the antipads has a portion extending towards an adjacent ground via. In contrast to the configuration shown in FIG. 12A in which the edges of the antipads are approximately equidistant between adjacent signal and ground vias, the antipads illustrated in FIG. 12B have an edge that is closer to the ground via than the signal via. In the embodiment illustrated, the edges of the antipads extend to or beyond a line tangent to the ground via and perpendicular to column $C_{10}$. For example, antipad $\mathbf{1222}_1$ extends towards via $\mathbf{1240}_1$A past tangent line $\mathbf{1270}_1$. Likewise, antipad $\mathbf{1222}_2$ extends towards ground via $\mathbf{1240}_1$B past tangent line $\mathbf{1270}_2$. In the opposite direction, antipad $\mathbf{1222}_2$ extends towards ground via $\mathbf{1240}_2$A past tangent line $\mathbf{1270}_3$. Similarly, antipad $\mathbf{1222}_3$ extends towards ground via $\mathbf{1240}_2$B past tangent line $\mathbf{1270}_4$.

The specific dimensions of the vias and antipads is not a limitation. However, in some embodiments, the vias may be formed by drilling a hole with a drill having a diameter between 0.3 and 0.7 millimeters. In some embodiments, a 0.55 millimeter drill may be used. Pads around the vias may extend the diameter of the via to a diameter between 0.7 millimeters and 1 millimeter. In some embodiments, the pads may have a diameter of 0.828 millimeters. The signal vias may be spaced on center by approximately 1.6 millimeters. The ground vias may be spaced on center by approximately 1.56 millimeters. The spacing between adjacent signal vias and ground vias may be approximately 1.1 millimeter. With such dimension, antipads configured as in FIG. 12A may extend from the center of a signal via approximately 0.539 mm. In the embodiment illustrated in FIG. 12B, the antipads may be elongated by approximately 0.35 millimeters in each direction along column $C_{10}$. With the dimensions, the tangent of the antipad extends to a point that is approximately 80% of the distance between the signal via and adjacent ground via. These diameters may result in the configuration illustrated in FIG. 12B. However, enlarged antipads may be used with vias of any suitable diameter and spacing.

FIG. 12B illustrates extended oval antipads. However, the shape of the antipads is not a limitation on the invention. For example, FIG. 12C illustrates an alternative embodiment using rectangular antipads. In each case, even if the outline of the antipad extends into the pad around a ground via, the pad is not removed, creating in some embodiments an antipad perimeter that is not a perfect rectangle or a perfect oval. FIG. 12C shows antipads $\mathbf{1224}_1$, $\mathbf{1224}_2$ and $\mathbf{1224}_3$ formed in ground layer 1214 of printed circuit board 1264. As shown, antipad $\mathbf{1224}_1$ encloses a pair of signal vias $\mathbf{1230}_1$A and $\mathbf{1230}_1$B. Antipad $\mathbf{1224}_2$ encloses a pair of signal vias $\mathbf{1230}_2$A and $\mathbf{1230}_2$B and antipad $\mathbf{1224}_3$ enclosed signal vias $\mathbf{1230}_3$A and $\mathbf{1230}_3$B. The pairs of signal vias are separated along column $C_{11}$ by ground vias. In the embodiment of FIG. 12C, the ground vias are shown in pairs, including ground vias $\mathbf{1240}_1$A and $\mathbf{1240}_1$B and the pair of ground vias $\mathbf{1240}_2$A and $\mathbf{1240}_2$B.

Though the antipads illustrated in FIG. 12C have a different shape than those of FIG. 12B, they similarly extend past the halfway point between a signal via and an adjacent ground via. In the embodiment shown, the antipads extend past the tangent of an adjacent ground via. For example, antipad $\mathbf{1224}_1$ extends towards ground via $\mathbf{1240}_1$A past tangent $\mathbf{1270}_1$. Similarly, antipad $\mathbf{1224}_2$ extends towards ground via $\mathbf{1240}_1$B past tangent $\mathbf{1270}_2$. At the opposing end, antipad $\mathbf{1224}_2$ extends towards ground via $\mathbf{1240}_2$A past tangent $\mathbf{1270}_3$. Similarly, antipad $\mathbf{1224}_3$ extends towards ground via $\mathbf{1240}_2$B past tangent $\mathbf{1270}_4$.

In the embodiment illustrated in FIG. 12C, the antipads extend past tangent lines $\mathbf{1270}_1$, $\mathbf{1270}_2$, $\mathbf{1270}_3$ and $\mathbf{1270}_4$ to approximately the center of the adjacent ground vias. Using pairs of ground vias facilitates such an arrangement. If a single ground via were used adjacent pairs of signal conductors, antipads surrounding pairs on opposite sides could not both extend to the center line of the ground via without completely surrounding the ground via by antipads. If the ground via were completely surrounded by antipads, it would not be connected to ground plane 1214 and could therefore exhibit undesirable electrical properties. However, by using pairs of ground conductors, a region of ground plane 1214 remains between the pairs. For example, even though antipads $\mathbf{1224}_1$ and $\mathbf{1224}_2$ on opposing sides of the pair of ground vias $\mathbf{1240}_1$A and $\mathbf{1240}_1$B each extend approximately to the center line of their adjacent ground vias, region $\mathbf{1280}_1$ of ground plane 1214 remains. Region $\mathbf{1280}_1$ connects both ground vias $\mathbf{1240}_1$A and $\mathbf{1240}_1$B to ground plane 1214 and may therefore promote desirable electrical properties of the ground vias. Additionally, region $\mathbf{1280}_1$ may aid in isolating signals passing through vias $\mathbf{1230}_1$A and $\mathbf{1230}_1$B from signals passing through vias $\mathbf{1230}_2$A and $\mathbf{1230}_2$B. Likewise, region $\mathbf{1280}_2$ between ground vias $\mathbf{1240}_2$A and $\mathbf{1240}_2$B may aid in connecting vias $\mathbf{1240}_2$A and $\mathbf{1240}_2$B to ground plane 1214 and may also isolate the signal carried on vias $\mathbf{1230}_2$A and $\mathbf{1230}_2$B from a signal carried on vias $\mathbf{1230}_3$A and $\mathbf{1230}_3$B.

Accordingly, in some embodiments it may be desirable to employ elongated antipads in columns in which pairs of signal vias are separated by pairs of ground vias. However, the specific configuration of vias is not a limitation on the invention and elongated antipads may be used within a suitable pattern of signal and ground vias.

Having thus described several aspects of at least one embodiment of this invention, it is to be appreciated various alterations, modifications, and improvements will readily occur to those skilled in the art.

For example, examples of techniques from modifying characteristics of an electrical connector were described. These techniques may be used alone or in any suitable combination.

As one specific example, FIGS. 12B and 12C illustrate elongated antipads used in a printed circuit board in which pairs of signal conductors are aligned with columns. Elongated antipads may also be used with rotated pairs as illustrated in FIG. 10B.

Further, although many inventive aspects are shown and described with reference to a daughter board connector, it should be appreciated that the present invention is not limited in this regard, as the inventive concepts may be included in other types of electrical connectors, such as backplane connectors, cable connectors, stacking connectors, mezzanine connectors, or chip sockets.

As a further example, connectors with four differential signal pairs in a column were used to illustrate the inventive concepts. However, the connectors with any desired number of signal conductors may be used.

Such alterations, modifications, and improvements are intended to be part of this disclosure, and are intended to be within the spirit and scope of the invention. Accordingly, the foregoing description and drawings are by way of example only.

What is claimed is:

1. A connector comprising:

a plurality of conductors, each conductor comprising a mating contact surface;

the plurality of conductors being disposed in a plurality of groups of conductors, each group of conductors being disposed in a corresponding column of a plurality of parallel columns;

each group of conductors comprising a plurality of pairs, each pair comprising a first conductor and a second conductor, the mating contact surface of the first conductor being disposed a first distance from a line along the column of the plurality of parallel columns in which the group containing the pair is disposed in a direction perpendicular to the column of the plurality of parallel columns in which the group containing the pair is disposed, and the mating contact surface of the second conductor being disposed a second distance from the line along the column in the direction perpendicular to the column of the plurality of parallel columns in which the group containing the pair is disposed, the first distance being different than the second distance.

2. The connector of claim 1, wherein the mating contact surface of each of the plurality of conductors faces the same direction.

3. The connector of claim 1, wherein:

the connector comprises a first connector and the plurality of conductors comprises a first plurality of conductors; and the first connector is in combination with a second connector, the second connector comprising:

a second plurality of conductors, the second plurality of conductors adapted and arranged to mate with corresponding conductors of the first plurality of conductors, the second plurality of conductors comprising a plurality of second pairs, each second pair comprising a first mating contact of a first conductor of the second plurality of conductors and a second mating contact of a second conductor of the second plurality of conductors, the first mating contact being disposed a third distance from the line along the column in the direction perpendicular to the column and the second mating contact being disposed a fourth distance from the line along the column in the direction perpendicular to the column, the third distance being different than the fourth distance.

4. The connector of claim 1, wherein the first conductor of each pair of conductors comprises a signal conductor.

5. The connector of claim 1, wherein the second conductor of each pair of conductors comprises a signal conductor.

6. The connector of claim 1, wherein each group comprises a plurality of wide conductors, the wide conductors disposed between adjacent pairs of the plurality of pairs.

7. The connector of claim 6, wherein first group comprises a first configuration and a second group, adjacent the first group, has a different configuration, whereby each wide conductor of the first group is adjacent a pair of the second group and each wide conductor of the second group is adjacent a pair of the first group.

8. The connector of claim 1, wherein each group of conductors further comprises a third conductor that is adjacent to each pair of conductors comprising the first conductor and the second conductor.

9. The connector of claim 8, wherein the corresponding column of the plurality of parallel columns is disposed along a centerline of the third conductor.

10. The connector of claim 8, wherein the third conductor that is adjacent to each pair of conductors is a ground conductor.

11. The connector of claim 8, wherein the mating contact surface of the third conductor is disposed a third distance from the line along the column of the plurality of parallel columns in which the group containing the pair is disposed, the third distance being perpendicular to the column and different from the first distance and the second distance.

12. The connector of claim 11, wherein the third distance is greater than at least one of the first distance and the second distance.

13. The connector of claim 11, wherein the third distance is less than at least one of the first distance and the second distance.

14. A connector system, comprising:

a first connector comprising:

a first plurality of conductors, each conductor comprising a mating contact surface;

the first plurality of conductors being disposed in a plurality of groups of conductors, each group of conductors being disposed in a corresponding plane of a plurality of parallel planes;

each group of conductors comprising a plurality of pairs, each pair comprising a first conductor and a second conductor, the mating contact surfaces of the first conductor and the second conductor being skewed in a direction perpendicular to the plane of the plurality of planes in which the group containing the pair is disposed;

a second connector comprising:

a second plurality of conductors, the second plurality of conductors adapted and arranged to mate with corresponding conductors of the first plurality of conductors, the second plurality of conductors comprising a plurality of second pairs, each second pair comprising a first mating contact of a first conductor of the second plurality of conductors and a second mating contact of a second conductor of the second plurality of conductors, the first mating contact skewed relative to the second mating contact in a direction perpendicular to the plane, and wherein for each second pair:

the first mating contact comprises a first surface parallel the plurality of planes, the first surface facing a first direction and each second mating contact comprises a second surface parallel with the plurality of planes and facing a second direction, opposite the first direction; and a first corresponding conductor of a pair of the first plurality of conductors mates with the first mating contact on the first surface;

a second corresponding conductor of the pair of the first plurality of conductors mates with the second mating contact on the second surface.

15. A connector comprising:

a plurality of conductors, each conductor comprising a mating contact surface;

the plurality of conductors being disposed in a plurality of groups of conductors, each group of conductors being disposed in a corresponding plane of a plurality of parallel planes;

each group of conductors comprising a plurality of pairs, each pair comprising a first conductor and a second conductor, the mating contact surfaces of the first conductor and the second conductor being skewed in a direction perpendicular to the plane of the plurality of planes in which the group containing the pair is disposed, wherein the mating contact portion of each of the conductors comprises a mating surface, and the mating contact portion for the first conductor of each pair faces a first direction and the mating contact portion for the second conductor of each pair faces a second direction, opposite the first direction.

* * * * *

UNITED STATES PATENT AND TRADEMARK OFFICE

CERTIFICATE OF CORRECTION

PATENT NO. : 7,794,278 B2
APPLICATION NO. : 12/062581
DATED : September 14, 2010
INVENTOR(S) : Thomas S. Cohen et al.

It is certified that error appears in the above-identified patent and that said Letters Patent is hereby corrected as shown below:

In the Specification:

At column 8, line number 56, change “An” to -- In --.

At column 11, line number 23, change “3405, 3406, 3407 and 3408” to -- $340_5$, $340_6$, $340_7$ and $340_8$ --.

At column 21, line number 26, change “angle a” to -- angle α --.

At column 23, line number 50, change “angle a” to -- angle α --.

Signed and Sealed this
Twenty-seventh Day of December, 2011

David J. Kappos

David J. Kappos
*Director of the United States Patent and Trademark Office*